US009511604B2

(12) United States Patent
Osuka et al.

(10) Patent No.: US 9,511,604 B2
(45) Date of Patent: Dec. 6, 2016

(54) CUTTING DEVICE

(71) Applicant: Brother Kogyo Kabushiki Kaisha, Nagoya-shi, Aichi-ken (JP)

(72) Inventors: Misato Osuka, Nagoya (JP); Yasutoshi Kano, Kariya (JP); Kohei Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/079,385

(22) Filed: Mar. 24, 2016

(65) Prior Publication Data

US 2016/0288540 A1 Oct. 6, 2016

(30) Foreign Application Priority Data

Mar. 31, 2015 (JP) ..... 2015-071158

(51) Int. Cl.

| | |
|---|---|
| ***B26D 1/157*** | (2006.01) |
| ***B26D 1/16*** | (2006.01) |
| ***B26D 5/06*** | (2006.01) |
| ***B26D 7/02*** | (2006.01) |
| ***B41J 11/66*** | (2006.01) |
| ***B26D 1/06*** | (2006.01) |

(52) U.S. Cl.

CPC ..... *B41J 11/663* (2013.01); *B26D 1/065* (2013.01); *B26D 7/025* (2013.01)

(58) Field of Classification Search

CPC ..... B41J 11/663; B41J 11/70; B41J 23/025; B26D 1/065; B26D 7/025

See application file for complete search history.

(56) References Cited

U.S. PATENT DOCUMENTS

| | | | | |
|---|---|---|---|---|
| 5,224,408 | A * | 7/1993 | Steidinger | B26D 7/2614 83/346 |
| 5,699,710 | A * | 12/1997 | Creaden | B26D 3/14 493/370 |
| 2013/0287467 | A1* | 10/2013 | Takahashi | B26D 1/085 400/621 |
| 2015/0084262 | A1 | 3/2015 | Sago et al. | |

FOREIGN PATENT DOCUMENTS

| | | |
|---|---|---|
| JP | 2005-324404 A | 11/2005 |
| JP | 2015-085507 A | 5/2015 |

OTHER PUBLICATIONS

Sep. 2, 2016—(EP) Extended Search Report—App 16162378.0.

* cited by examiner

*Primary Examiner* — Stephen Meier
*Assistant Examiner* — Alexander D Shenderov
(74) *Attorney, Agent, or Firm* — Banner & Witcoff, Ltd.

(57) ABSTRACT

A cutting device includes a receiving block configured such that an object to be cut is arranged thereon, a cutting blade that includes a blade portion, the cutting blade being configured to move between a separated position and a contact position via a clamping position, a first rotating member coupled with the cutting blade, the first rotating member being configured to cause the cutting blade to move from the separated position to the contact position via the clamping position, by the first rotating member rotating in a specified direction from a separated rotation position to a contact rotation position via a clamping rotation position, an elastic member provided on the first rotating member, a DC motor, and a second rotating member configured to rotate in accordance with rotation of the DC motor.

11 Claims, 19 Drawing Sheets

FIG. 17

450

| TUBE OUTER DIAMETER Z | URGING TIME PERIOD T |
|---|---|
| z1 [mm] | t1 [s] |
| z2 [mm] | t2 [s] |

CUTTING DEVICE

CROSS-REFERENCE TO RELATED APPLICATION

This application claims priority to Japanese Patent Application No. 2015-071158 filed Mar. 31, 2015. The contents of the foregoing applications are hereby incorporated herein by reference.

BACKGROUND

The present disclosure relates to a cutting device.

A cutting device is known that can perform a full cut operation and a half cut operation on an object to be cut. The full cut operation is an operation that cuts the object into two or more pieces. The half cut operation is an operation that cuts the object while leaving a portion remaining. For example, a known cutting device includes a cutter receiver and a cutter blade. The cutter receiver is switched between a first state and a second state. The first state is a state in which a flat surface of the cutter receiver is opposed to the cutter blade. The second state is a state in which a surface of the cutter receiver on which a protrusion is formed is opposed to the cutter blade.

SUMMARY

It is assumed that the above-described cutting device includes a motor that causes the cutter blade to move. It is assumed that a stepping motor is adopted as the motor such that it is possible to adjust a load with which a tube is clamped between the cutter blade and the cutter receiver. However, in some cases, when the cutting device includes the stepping motor, this may increase the size of the cutting device.

Embodiments of the broad principles derived herein provide a cutting device that is downsized and capable of adjusting a load with which an object to be cut is clamped.

Embodiments provide a cutting device that includes a receiving block configured such that an object to be cut is arranged thereon, a cutting blade that includes a blade portion, the cutting blade being configured to move between a separated position and a contact position via a clamping position, the separated position being a position in which the blade portion is separated from the receiving block, the contact position being a position in which the blade portion is in contact with the receiving block, and the cutting blade being configured, when the cutting blade is in the clamping position, to clamp the object between the blade portion and the receiving block, a first rotating member coupled with the cutting blade, the first rotating member being configured to cause the cutting blade to move from the separated position to the contact position via the clamping position, by the first rotating member rotating in a specified direction from a separated rotation position to a contact rotation position via a clamping rotation position, an elastic member provided on the first rotating member, a DC motor, and a second rotating member configured to rotate in accordance with rotation of the DC motor, the second rotating member being configured to cause the first rotating member to rotate from the separated rotation position to the clamping rotation position by the second rotating member rotating in a first direction from an initial rotation position to a first intermediate rotation position while being in contact with the elastic member, and the second rotating member being configured to increase an amount of elastic deformation of the elastic member and urge the first rotating member in the specified direction by the second rotating member rotating in the first direction from the first intermediate rotation position while being in contact with the elastic member.

BRIEF DESCRIPTION OF THE DRAWINGS

Embodiments will be described below in detail with reference to the accompanying drawings in which:

FIG. 17 is a data configuration diagram of a data table 450;

DETAILED DESCRIPTION

[1. Overview of Printer 1]

A printer 1 that is an example of an embodiment will be explained with reference to the drawings. In the following explanation, the upper side, the lower side, the lower right side, the upper left side, the upper right side, and the lower left side of FIG. 1 respectively define the upper side, the lower side, the front side, the rear side, the right side, and the left side of the printer 1.

Figure 1:
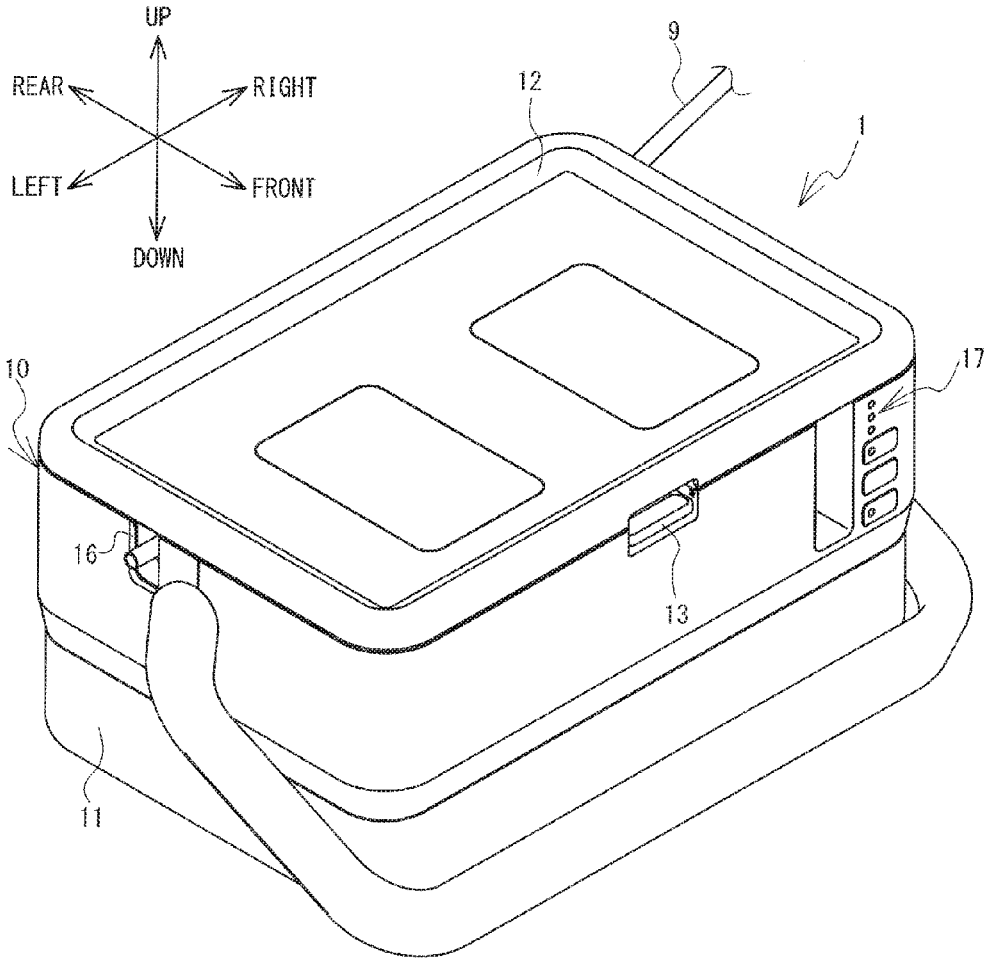
FIG. 1 is a perspective view of a printer 1.
Figure 2:
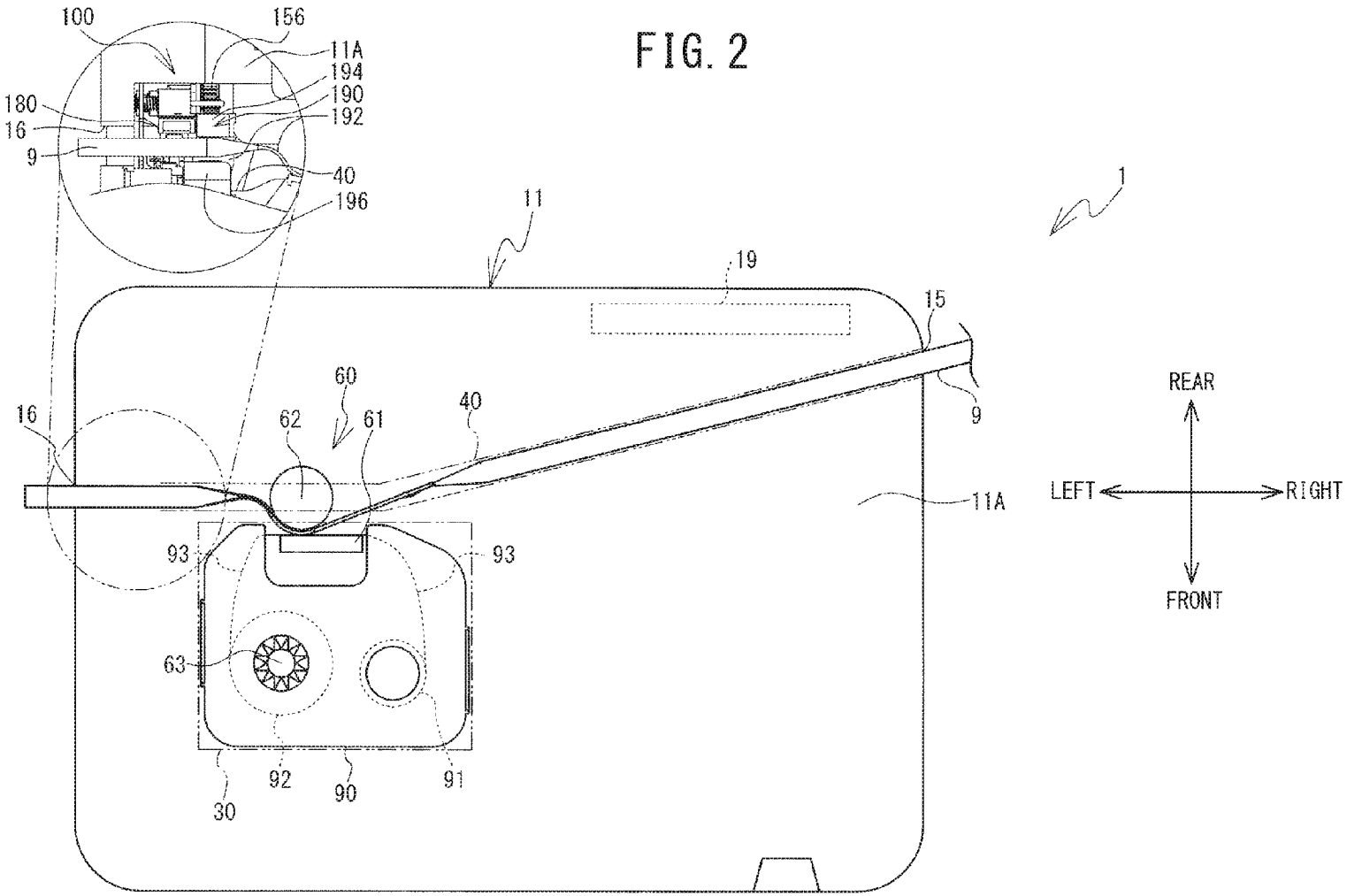
FIG. 2 is a plan view of an interior of a main body case 11.

The printer 1 shown in FIG. 1 and FIG. 2 performs printing on a tube 9, which is a cylindrical print medium. The printer 1 can cut the tube 9 after printing. The printer 1 can perform one of a half cut operation and a full cut operation on the tube 9 after printing. The full cut operation of the present example is an operation in which the whole periphery of the tube 9 is cut such that the tube 9 is cut into two or more pieces. The half cut operation of the present example is an operation in which the tube 9 is cut such that a part of the periphery of the tube 9 is left remaining. Hereinafter, when the half cut and the full cut operations are collectively referred to, they are referred to as a cutting operation.

Figure 11A:
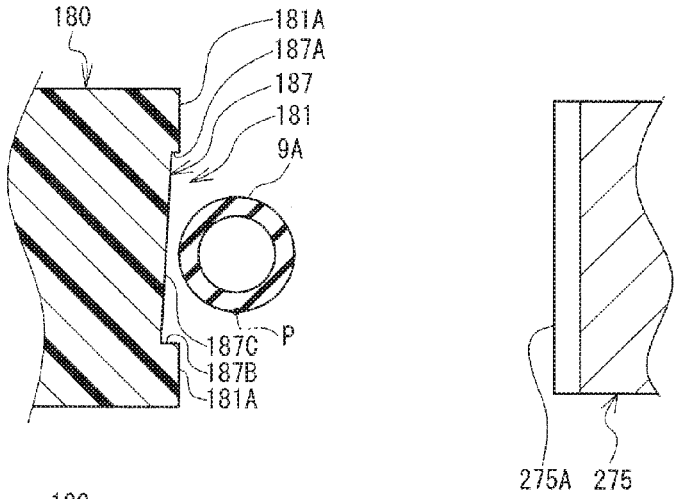
FIG. 11A is a diagram showing a positional relationship between the receiving block 180, a cutting blade 275, and a large diameter tube 9A.
Figure 11B:
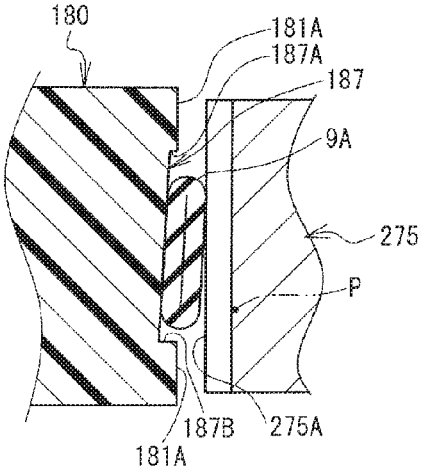
FIG. 11B is a diagram showing a positional relationship between the receiving block 180, the cutting blade 275, and the large diameter tube 9A.
Figure 11C:
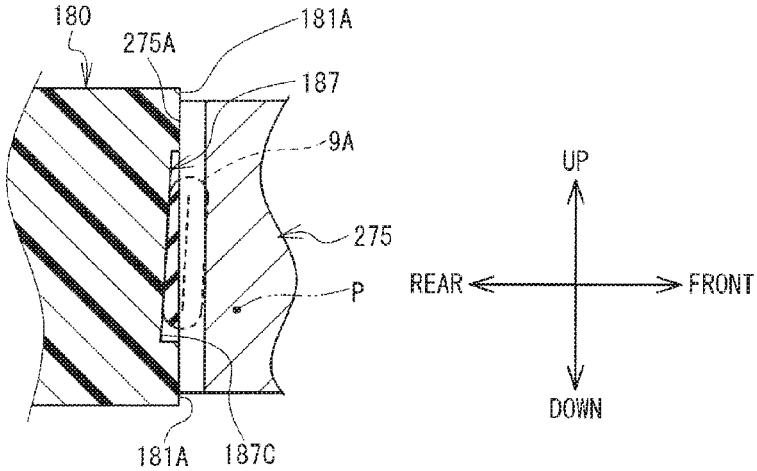
FIG. 11C is a diagram showing a positional relationship between the receiving block 180, the cutting blade 275, and the large diameter tube 9A.
Figure 12A:
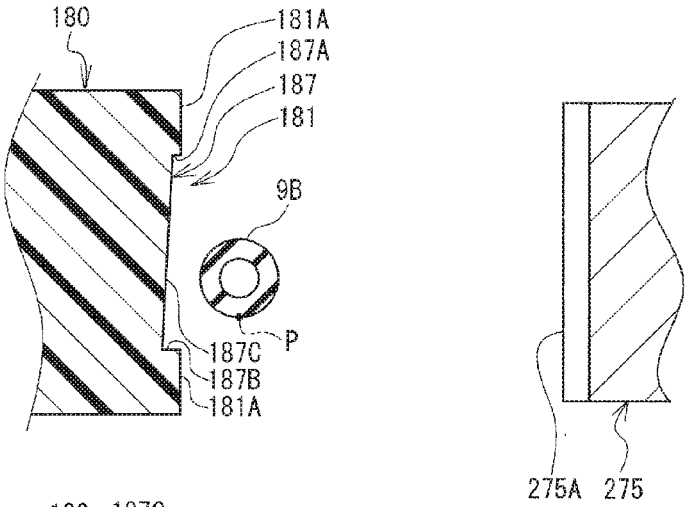
FIG. 12A is a diagram showing a positional relationship between the receiving block 180, the cutting blade 275, and a small diameter tube 9B.
Figure 12B:
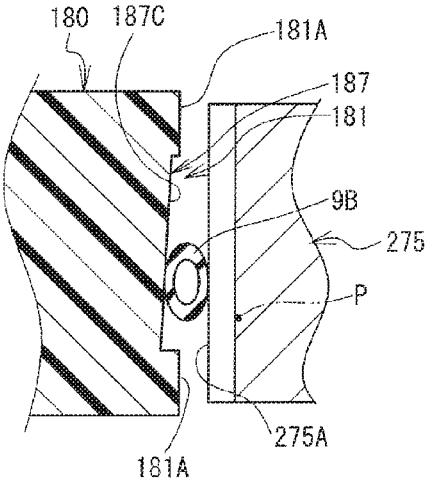
FIG. 12B is a diagram showing a positional relationship between the receiving block 180, the cutting blade 275, and the small diameter tube 9B.
Figure 12C:
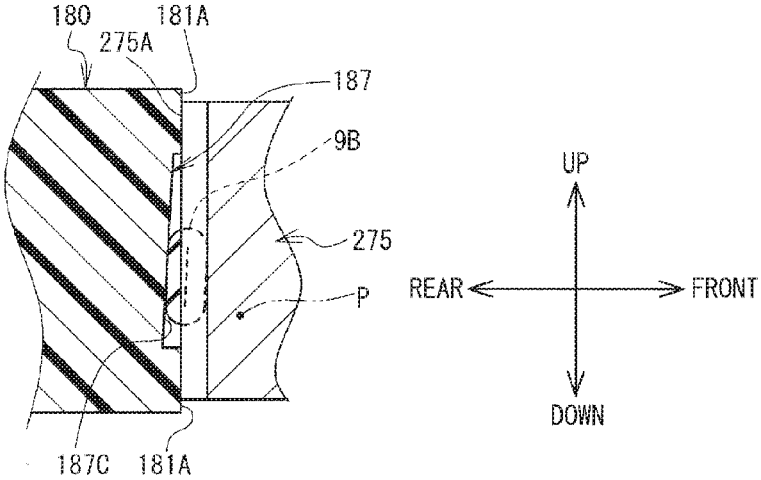
FIG. 12C is a diagram showing a positional relationship between the receiving block 180, the cutting blade 275, and the small diameter tube 9B.

The tube 9 of the present example includes a large diameter tube 9A (refer to FIG. 11A to FIG. 11C) and a small diameter tube 9B (refer to FIG. 12A to FIG. 12C). The large diameter tube 9A is, for example, a tube having an outer diameter of 7.5 mm and an inner diameter of 6.5 mm. The small diameter tube 9B is, for example, a tube having an outer diameter of 4.5 mm and an inner diameter of 4 mm.

As shown in FIG. 1, the printer 1 includes a housing 10, which includes a main body case 11 and a cover 12. The main body case 11 is a cuboid box-shaped member that is long in the left-right direction. The cover 12 is a plate-shaped member that is disposed on the upper side of the main body case 11. A rear end portion of the cover 12 is rotatably supported on the upper side of a rear end portion of the main body case 11. A lock mechanism 13 is provided on the upper side of a front end portion of the main body case 11. The lock mechanism 13 latches a front end portion of the cover 12 when the cover 12 is closed with respect to the main body case 11, and regulates the opening and closing of the cover 12.

When the cover 12 is closed with respect to the main body case 11 (refer to FIG. 1), the cover 12 covers a mounting surface 11A (refer to FIG. 2). The mounting surface 11A is an upper surface of the main body case 11. When a user opens the cover 12, the user may operate the lock mechanism 13 to release the latching of the cover 12. After that, the user may rotate the cover 12 upward away from the lock mechanism 13. When the cover 12 has been opened with respect to the main body case 11, the mounting surface 11A is exposed in the upward direction (refer to FIG. 2).

Side surfaces of the housing 10 are provided with an operation portion 17, a tube insertion opening 15 (refer to FIG. 2), and a tube discharge opening 16. The operation portion 17 is configured by a plurality of operation buttons, including a power source button and a start button. The operation portion 17 is provided on an upper right portion of the front surface of the main body case 11. The tube insertion opening 15 is an opening to guide the tube 9 to the inside of the housing 10. The tube insertion opening 15 is provided on an upper rear portion of the right surface of the main body case 11. The tube insertion opening 15 is a rectangular shape that is slightly long in the up-down direction. The tube discharge opening 16 is an opening to discharge the tube 9 to the outside of the housing 10. The tube discharge opening 16 is provided on an upper rear portion of the left surface of the main body case 11. The tube discharge opening 16 is a rectangular shape that is slightly long in the up-down direction. The tube discharge opening 16 is provided slightly further toward the front side than the tube insertion opening 15.

As shown in FIG. 2, a ribbon mounting portion 30 and a tube mounting portion 40 etc. are provided on the mounting surface 11A. The ribbon mounting portion 30 is a portion into which a ribbon cassette 90 can be removably mounted. The ribbon mounting portion 30 is a recessed portion that is open in the upward direction. The ribbon mounting portion 30 is formed as an open shape substantially corresponding to the ribbon cassette 90 in a plan view. The ribbon mounting portion 30 of the present example is provided in a left portion of the mounting surface 11A and to the front of the tube mounting portion 40.

The tube mounting portion 40 is a portion into which the tube 9 can be removably mounted. The tube mounting portion 40 is a groove portion that is open in the upward direction. The tube mounting portion 40 extends from the tube insertion opening 15 to the vicinity of the right side of the tube discharge opening 16. As described above, the tube discharge opening 16 is provided slightly further toward the front side than the tube insertion opening 15. As a result, the tube mounting portion 40 extends substantially in the left-right direction while tilting slightly toward the front left side. The direction in which the tube mounting portion 40 extends from the tube insertion opening 15 toward the tube discharge opening 16 is referred to as a tube feed direction. The tube feed direction is parallel to a plane that is parallel to the left-right direction and the front-rear direction. The tube feed direction is orthogonal to the up-down direction. An opening cross section of the tube mounting portion 40 is slightly larger than a transverse cross-section of the tube 9, apart from a portion at which the tube mounting portion 40 and the ribbon mounting portion 30 are connected spatially. The opening cross section of the tube mounting portion 40 is orthogonal to the tube feed direction. The transverse cross-section of the tube 9 is orthogonal to an extending direction of the tube 9. The user may mount the tube 9 in the tube mounting portion 40 along the tube feed direction such that the tube 9 extends from the tube insertion opening 15 as far as the tube discharge opening 16.

Figure 16:
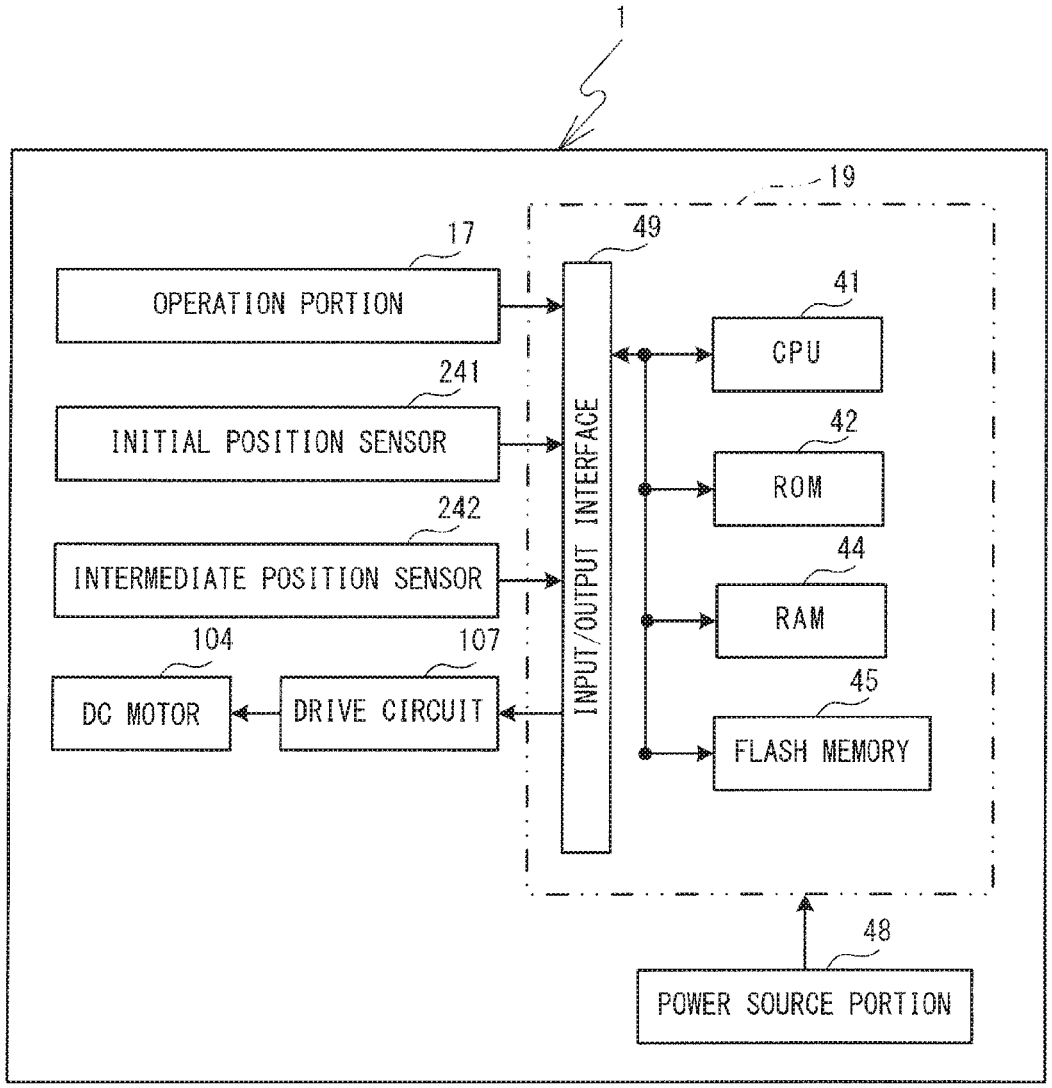
FIG. 16 is an electrical block diagram of the printer 1.

A control board 19, a power source portion 48 (refer to FIG. 16), a tube printing mechanism 60, and the ribbon cassette 90 will be explained with reference to FIG. 2. The control board 19 is a board on which are provided a CPU 41, a ROM 42, a RAM 44, and the like as shown in FIG. 16. The control board 19 controls various operations of the printer 1. The control board 19 controls a printing operation of the tube printing mechanism 60, for example. The control board 19 of the present example is provided on a rear right portion inside the main body case 11. The control board 19 extends in the up-down direction and the left-right direction. The power source portion 48 is connected to a battery (not shown in the drawings) mounted inside the main body case 11, or is connected via a cord to an external power source (not shown in the drawings). The power source portion 48 supplies electric power to the printer 1. The power source portion 48 of the present example is provided to the front of the control board 19.

The ribbon cassette 90 is a box-like body that can house an ink ribbon 93. A ribbon roll 91 and a ribbon take-up spool 92 are rotatably supported inside the ribbon cassette 90. The ribbon roll 91 is the ink ribbon 93 that has not yet been used and that is wound on a spool (not shown in the drawings). The ribbon take-up spool 92 is a spool on which the used ink ribbon 93 is wound.

The tube printing mechanism 60 includes a print head 61, a movable feed roller 62, a ribbon take-up shaft 63, a drive motor (not shown in the drawings), and the like. The print head 61 and the ribbon take-up shaft 63 extend upward from a bottom surface of the ribbon mounting portion 30. The print head 61 is provided in a rear portion of the ribbon mounting portion 30. The print head 61 is a thermal head that includes a heating element (not shown in the drawings). The ribbon take-up shaft 63 is a shaft around which the ribbon take-up spool 92 can rotate.

The movable feed roller 62 is a rotatable roller. The movable feed roller 62 is disposed to the rear of the ribbon mounting portion 30. The movable feed roller 62 is opposed to the print head 61. The movable feed roller 62 can be switched between an operating position and a retracted position, in accordance with the closing and opening of the cover 12 (refer to FIG. 1). When the movable feed roller 62 is in the operating position, the movable feed roller 62 is disposed inside the tube mounting portion 40 and is in proximity to the print head 61. When the movable feed roller 62 is in the retracted position, the movable feed roller 62 is disposed to the rear of the tube mounting portion 40, and is separated from the print head 61. The drive motor (not shown in the drawings) is a motor that rotationally drives the movable feed roller 62 and the ribbon take-up shaft 63.

When the cover 12 is open, the movable feed roller 62 is displaced to the retracted position. When the ribbon cassette 90 is mounted in the ribbon mounting portion 30, the ribbon take-up shaft 63 is inserted into the ribbon take-up spool 92. After that, when the cover 12 is closed, the movable feed roller 62 is displaced to the operating position. The movable feed roller 62 overlaps the tube 9 in the tube mounting portion 40 with the unused ink ribbon 93 and urges the tube 9 and the unused ink ribbon 93 toward the print head 61. At this time, the tube 9 is elastically deformed as a result of the urging force of the movable feed roller 62, and the ink ribbon 93 is clamped between a surface of the tube 9 and the print head 61.

The tube printing mechanism 60 performs the following print operation in accordance with control of the control board 19. The drive motor of the tube printing mechanism 60 causes the movable feed roller 62 and the ribbon take-up shaft 63 to rotate. In accordance with the rotation of the movable feed roller 62, the tube 9 inside the tube mounting portion 40 is fed to a downstream side in the tube feed direction. At that time, the tube 9 before printing that is outside the housing 10 is pulled into the inside of the tube mounting portion 40, from the right surface of the main body case 11 via the tube insertion opening 15. When the ribbon take-up spool 92 rotates in accordance with the rotation of the ribbon take-up shaft 63, the ink ribbon 93 is pulled out from the ribbon roll 91.

The print head 61 uses the pulled out ink ribbon 93 to print a character on the tube 9 being fed. The print head 61 of the present example prints a normal image of the character on a front surface of the tube 9 that passes to the rear of the print head 61. Thus, the front surface of the tube 9 is a print surface of the tube 9. The used ink ribbon 93 is taken up by the ribbon take-up spool 92. The tube 9 after printing is fed by the movable feed roller 62 to the downstream side in the tube feed direction. The tube 9 is discharged from the main body case 11 via the left end portion of the tube mounting portion 40 and the tube discharge opening 16.

[2. Structure of Cutting Mechanism 100 and Overview of its Operations]

As shown in FIG. 2, the cutting mechanism 100 is provided between the left end portion of the tube mounting portion 40 and the tube discharge opening 16. The cutting mechanism 100 is a mechanism to perform the cutting operation on the tube 9 after printing. An overview of the cutting mechanism 100 is as follows. The cutting mechanism 100 includes a cutting blade 275 (refer to FIG. 11A to FIG. 11C), and a receiving block 180. The cutting blade 275 and the receiving block 180 are opposed to each other on either side of a tube feed path 9C (refer to FIG. 3). The tube feed path 9C is a path along which the tube 9 is fed from the left end portion of the tube mounting portion 40 to the tube discharge opening 16. The tube feed path 9C extends in the left-right direction. After the tube 9 is disposed on the receiving block 180, the cutting mechanism 100 causes the cutting blade 275 to move toward the receiving block 180. The cutting blade 275 clamps the tube 9 between the cutting blade 275 and the receiving block 180. When the cutting blade 275 presses the tube 9 toward the receiving block 180, the cutting operation on the tube 9 is performed. The cutting mechanism 100 switches the cutting operation on the tube 9 between a half cut operation and a full cut operation, by switching a position of the receiving block 180 in the left-right direction.

Figure 3:
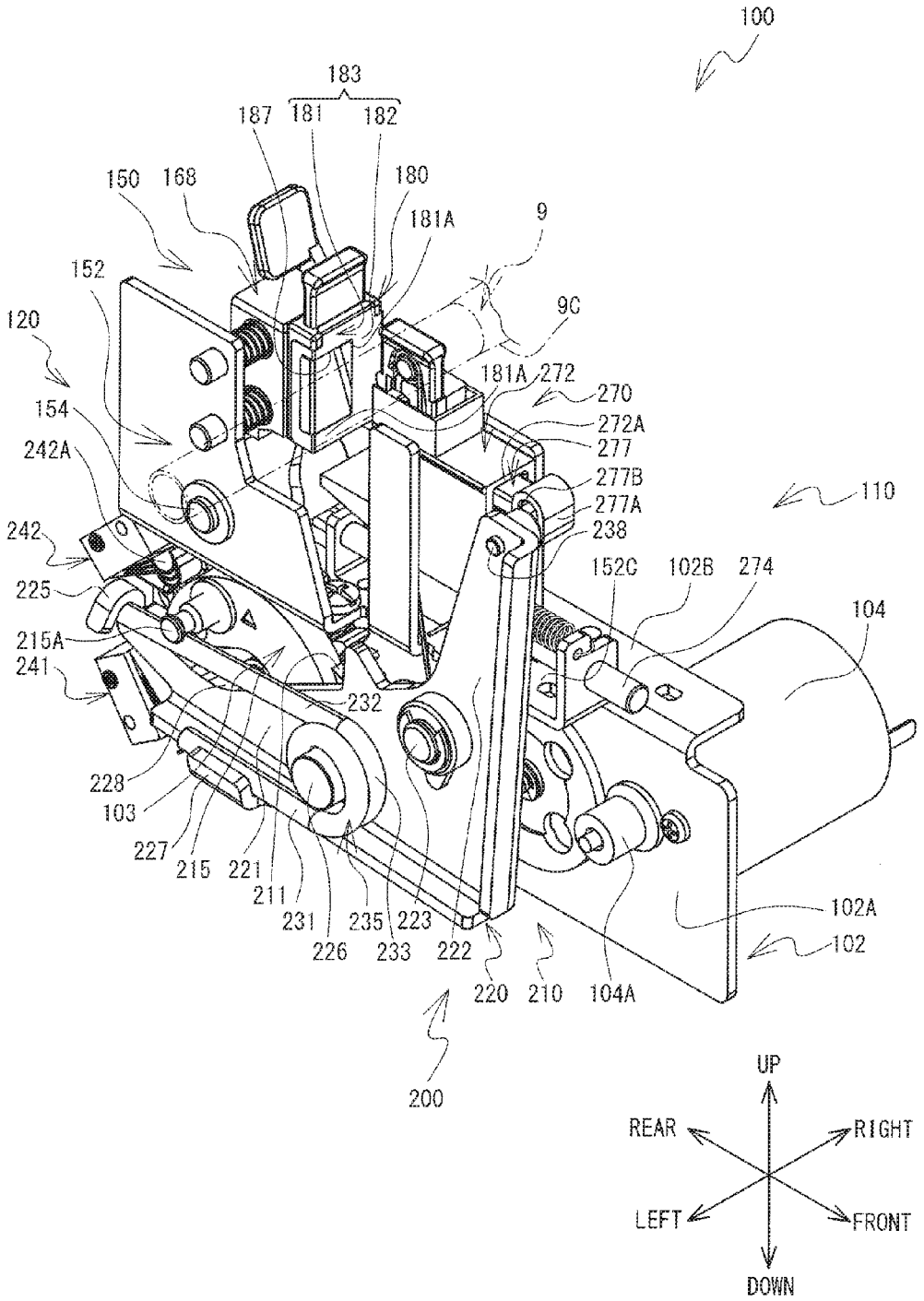
FIG. 3 is a perspective view of a cutting mechanism 100 as seen from the front left.

As shown in FIG. 3, the cutting mechanism 100 includes a positioning portion 190 (refer to FIG. 2), a drive portion 110, a receiving block movement mechanism 120, and a cutting blade movement mechanism 200. The positioning portion 190 guides the tube 9 after printing toward the receiving block 180 while determining a position of the tube 9 in the up-down direction. The drive portion 110 drives the receiving block movement mechanism 120 and the cutting blade movement mechanism 200. The receiving block movement mechanism 120 is a mechanism that supports the receiving block 180 such that the receiving block 180 can move linearly in the left-right direction. The cutting blade movement mechanism 200 is a mechanism that supports the cutting blade 275 such that the cutting blade 275 can move in the front-rear direction.

[2-1. Positioning Portion 190]

As shown in FIG. 2, the positioning portion 190 is disposed further to the downstream side, in the tube feed direction, than the left end portion of the tube mounting portion 40. The positioning portion 190 includes a bottom wall portion 192, a rear wall portion 194, and a front wall portion 196. The bottom wall portion 192 is a wall portion disposed at substantially the same height as a bottom portion of the tube mounting portion 40. A shape of the bottom wall portion 192 is substantially rectangular in a plan view. The bottom wall portion 192 can come into contact with the tube 9 from below and restrict a downward movement of the tube 9. In this manner, the bottom wall portion 192 can determine a position, in the up-down direction, of the tube 9 supplied to the cutting mechanism 100. Hereinafter, a position in the up-down direction of the lower end of the tube 9 that is positioned by the bottom wall portion 192 is referred to as a reference position P (refer to FIG. 11A to FIG. 11C).

The rear wall portion 194 and the front wall portion 196 are wall portions that extend upward from a rear end portion and a front end portion of the bottom wall portion 192, respectively. The rear wall portion 194 and the front wall portion 196 are opposed to each other from either side of the tube feed path 9C. A distance between the rear wall portion 194 and the front wall portion 196 in the direction in which the rear wall portion 194 and the front wall portion 196 are opposed to each other is slightly longer than the outer diameter of the large diameter tube 9A.

[2-2. Drive Portion 110]

Figure 4:
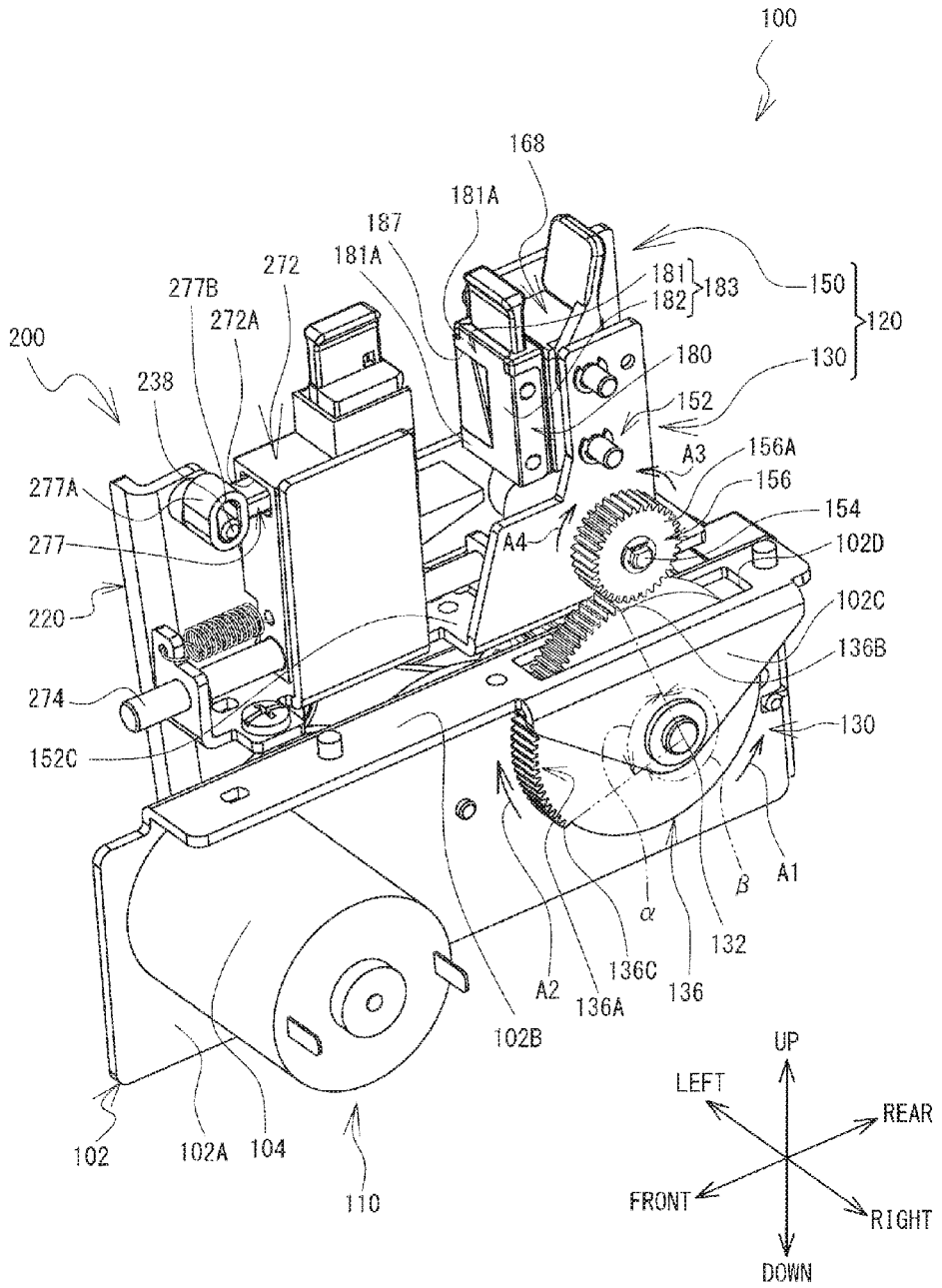
FIG. 4 is a perspective view of the cutting mechanism 100 as seen from the front right.

As shown in FIG. 3 and FIG. 4, the drive portion 110 is provided below the tube feed path 9C. The drive portion 110 includes a support portion 102, a DC motor 104, and a gear group 105 (refer to FIG. 5). The support portion 102 includes a first plate portion 102A, a second plate portion 102B, and a third plate portion 102C (refer to FIG. 4). The first plate portion 102A is a plate-shaped portion that extends in the up-down direction and the front-rear direction. The second plate portion 102B is a plate-shaped portion that extends to the right from an upper end portion of the first plate portion 102A. A plate body 99 (refer to FIG. 9) is attached to an upper surface of the second plate portion 102B. The plate body 99 extends in the left-right direction and the front-rear direction. The third plate portion 102C (refer to FIG. 4) is a plate-shaped body that extends downward, from a rear portion of the right end portion of the second plate portion 102B. An opening portion 102D (refer to FIG. 4) is provided in a rear portion of the second plate portion 102B. The opening portion 102D penetrates in the up-down direction.

The DC motor 104 is fixed to a front portion of a right surface of the first plate portion 102A. An output shaft of the DC motor 104 penetrates through the first plate portion 102A. A motor gear 104A is provided on a leading end portion of the output shaft of the DC motor 104.

Figure 5:
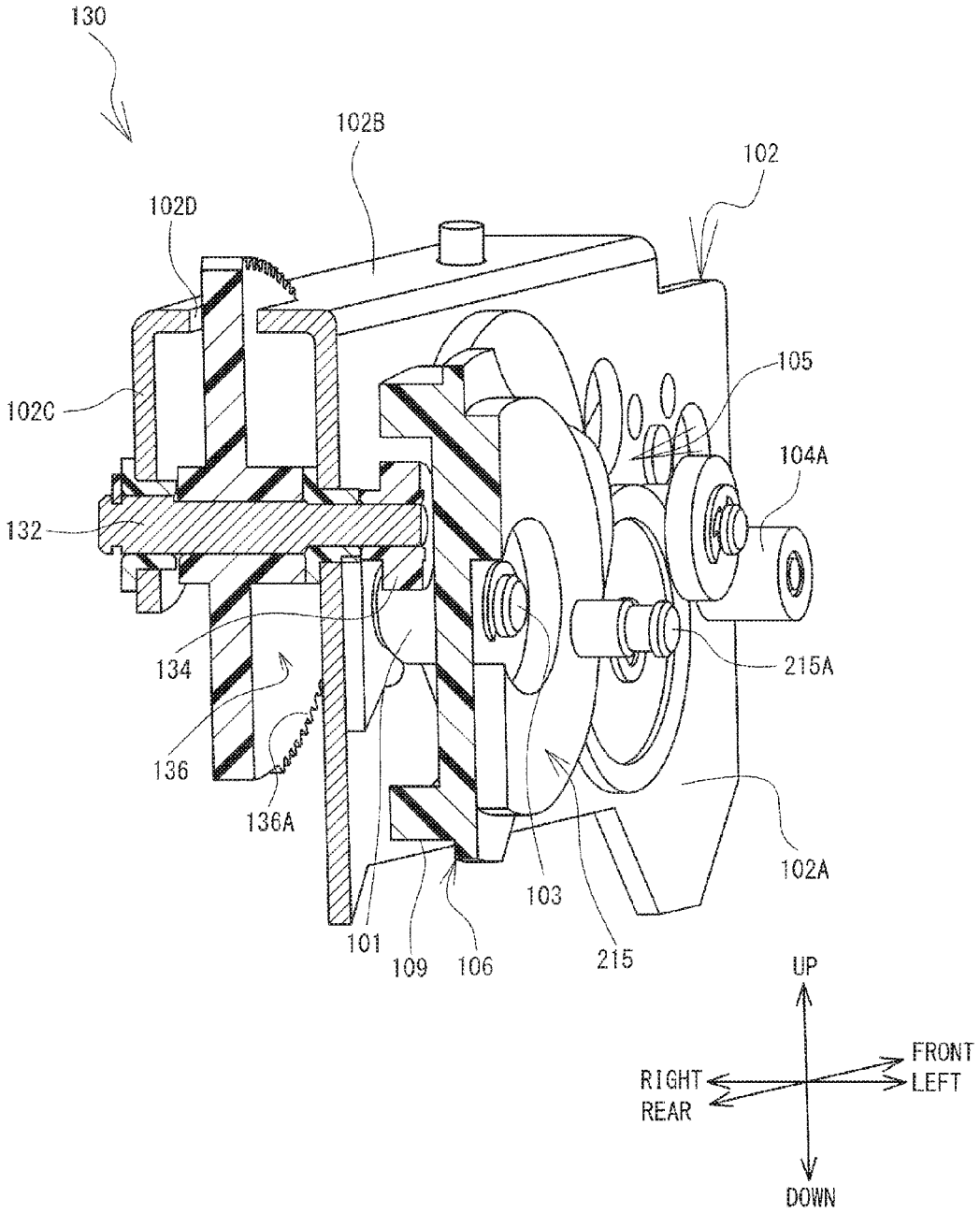
FIG. 5 is a cross-sectional perspective view of an intermittent gear 136 and a rotating member 106.

The gear group 105 (refer to FIG. 5) includes a plurality of gears. The plurality of gears are rotatably provided on shaft portions that extend to the left from the left surface of the first plate portion 102A, respectively. In FIG. 3 and FIG. 5, some of the plurality of gears are not illustrated.

As shown in FIG. 5, the gear group 105 connects the motor gear 104A to a first gear portion 109. The first gear portion 109 is ring-shaped in a right side view. The first gear portion 109 is integrally formed with a rotating member 106, which is a disc-shaped member having a thickness in the left-right direction. The rotating member 106 is rotatably supported by a rotating shaft portion 103. The rotating shaft portion 103 is fixed to a rear portion of the left surface of the first plate portion 102A. The rotating shaft portion 103 extends in the left-right direction. A driving force of the DC motor 104 is transmitted to the first gear portion 109 via the motor gear 104A and the gear group 105, and the first gear portion 109 rotates around the rotating shaft portion 103 as a result.

The rotating member 106 includes a second gear portion 101. Of a right portion of the rotating member 106, the second gear portion 101 is formed on the inside of the first gear portion 109. The second gear portion 101 rotates with the first gear portion 109, around the rotating shaft portion 103.

[2-3. Receiving Block Movement Mechanism 120]

The receiving block movement mechanism 120 will be explained with reference to FIG. 4 and FIG. 8. The receiving block movement mechanism 120 includes a drive transmission portion 130 and a receiving block support portion 150. The drive transmission portion 130 is coupled to the DC motor 104. The receiving block support portion 150 causes the receiving block 180 to move in the left-right direction by a driving force transmitted by the drive transmission portion 130.

Of the drive transmission portion 130, a holding member 152, a cam drive gear 156, and a cam member 158, which will be explained below, are not illustrated in FIG. 3. Of the drive transmission portion 130, a support shaft 132, a gear 134, and an intermittent gear 136, which will be explained below, are not illustrated in FIG. 4.

[2-3-1. Drive Transmission Portion 130]

Figure 6:
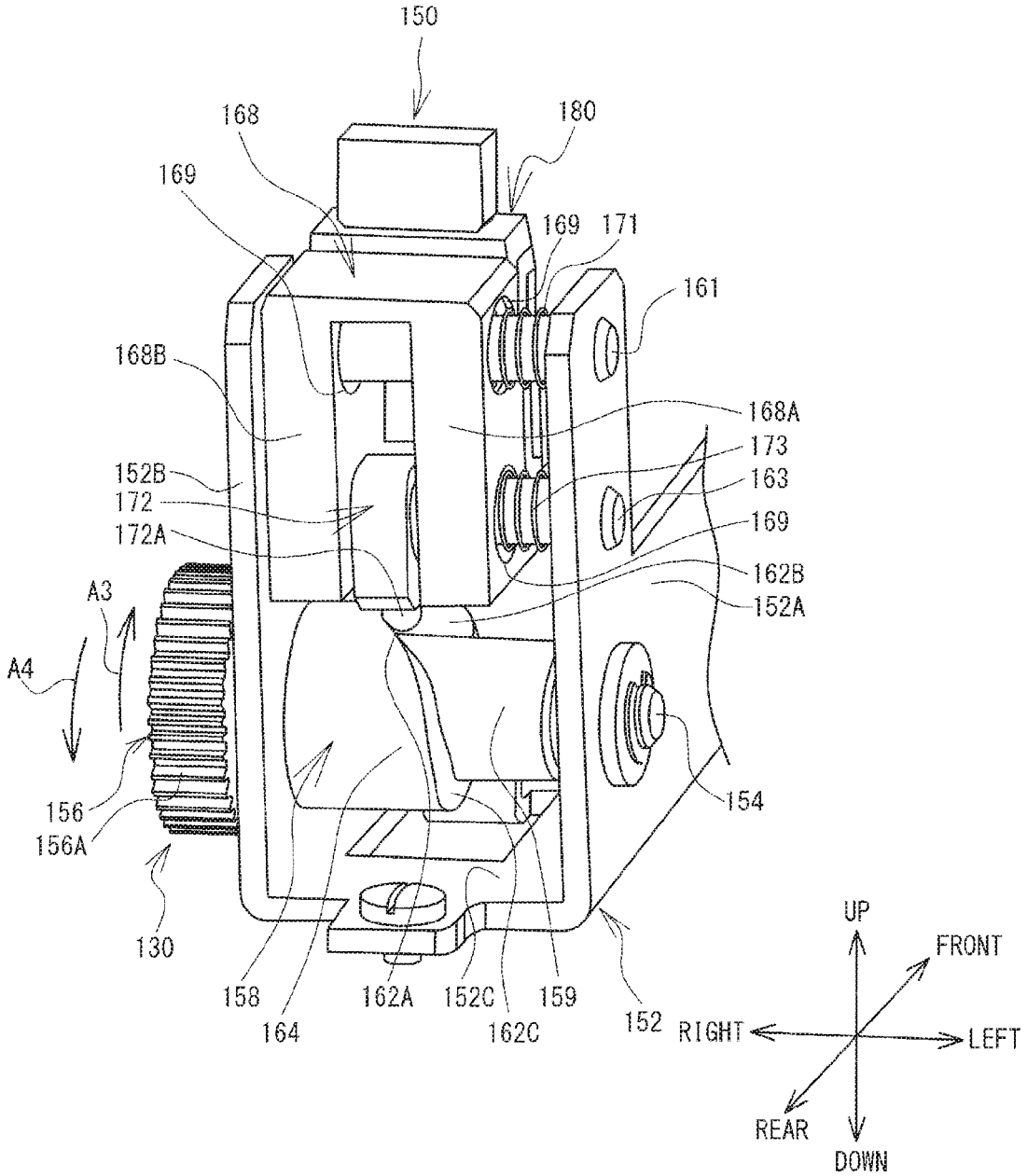
FIG. 6 is a perspective view of a receiving block support portion 150 when a receiving block 180 is in a first opposed position.

As shown in FIG. 4 and FIG. 5, the drive transmission portion 130 includes the support shaft 132, the gear 134 (refer to FIG. 5), the intermittent gear 136, the holding member 152 (refer to FIG. 4), a first shaft portion 154 (refer to FIG. 4), the cam drive gear 156 (refer to FIG. 4), and the cam member 158 (refer to FIG. 6). The support shaft 132 is rotatably supported by the first plate portion 102A and the third plate portion 102C. The support shaft 132 is a shaft portion that extends in the left-right direction. The support shaft 132 extends further to the left side than the first plate portion 102A.

The gear 134 is supported by the support shaft 132, further to the left side than the first plate portion 102A. The gear 134 meshes with the second gear portion 101. As a result, when the above-described first gear portion 109 rotates in accordance with the rotation of the DC motor 104, the second gear portion 101 causes the support shaft 132 to rotate.

The intermittent gear 136 is supported by the support shaft 132, between the first plate portion 102A and the third plate portion 102C. A part of a circumferential surface of the intermittent gear 136 is exposed upward from the opening portion 102D of the second plate portion 102B.

The intermittent gear 136 can rotate with the support shaft 132. Hereinafter, of rotation directions of the intermittent gear 136 around the support shaft 132, the anti-clockwise direction in a right side view is referred to as a first rotation direction, and the direction opposite to the first rotation direction is referred to as a second rotation direction. The first rotation direction is a direction in which an arrow A1 shown in FIG. 4 is oriented. The second rotation direction is a direction in which an arrow A2 shown in FIG. 4 is oriented. When the DC motor 104 rotates in the forward direction, the intermittent gear 136 rotates in the first rotation direction. When the DC motor 104 rotates in the reverse direction, the intermittent gear 136 rotates in the second rotation direction. The reverse direction is the opposite direction to the forward direction.

As shown in FIG. 4, a first toothed portion 136A is provided on a part of the circumferential surface of the intermittent gear 136 in the rotation direction. The first toothed portion 136A includes a first end portion 136B and a second end portion 136C. The first end portion 136B is an end portion of the first toothed portion 136A in the second rotation direction (the direction of the arrow A2). The second end portion 136C is an end portion of the first toothed portion 136A in the first rotation direction (the direction of the arrow A1).

An angle over which the toothed portion is formed (a toothed portion formation angle) is an angle from the first end portion 136 B to the second end portion 136C, in the first rotation direction. The toothed portion formation angle is an angle $\alpha$ shown in FIG. 4. The toothed portion formation angle of the intermittent gear 136 is, as an example, 76 degrees. An angle over which the toothed portion is not formed (a toothed portion non-formation angle) is an angle from the first end portion 136B to the second end portion 136C in the second rotation direction. The toothed portion non-formation angle is an angle $\beta$ shown in FIG. 4. The toothed portion non-formation angle of the intermittent gear 136 is, as an example, 284 degrees.

Figure 9:
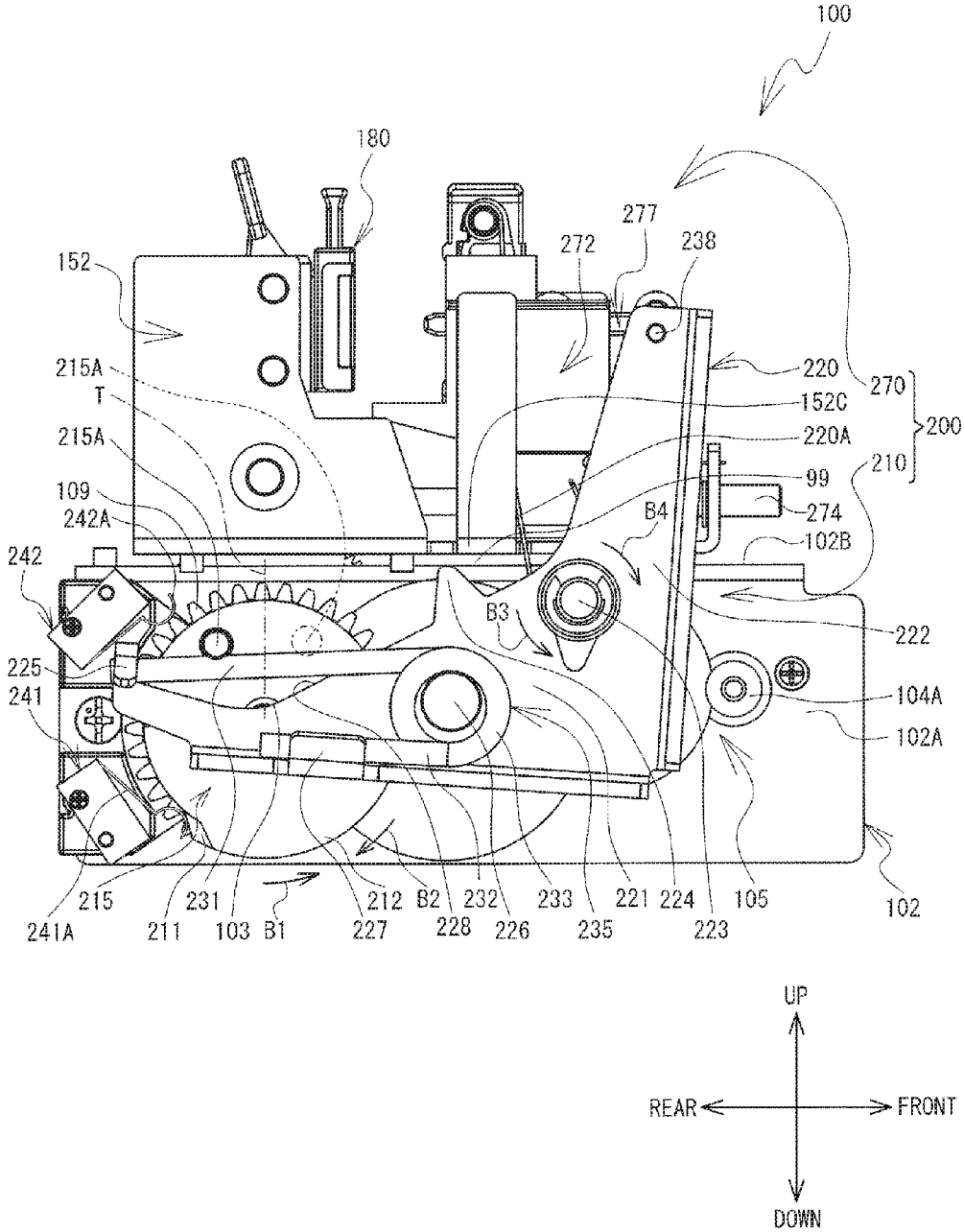
FIG. 9 is a left side view of the cutting mechanism 100 in an initial state.

As shown in FIG. 4 and FIG. 6, the holding member 152 is provided on an upper surface of the plate body 99 (refer to FIG. 9). The holding member 152 is disposed on the upper left side with respect to the intermittent gear 136. The holding member 152 includes a left plate 152A, a right plate 152B, and a lower plate 152C. The left plate 152A and the right plate 152B are opposed to each other with a gap between them in the left-right direction. The left plate 152A and the right plate 152B are plate-shaped bodies having an L shape in a left side view. The left plate 152A and the right plate 152B each have a thickness in the left-right direction.

An inside corner portion of the L shape, in the side view, of each of the left plate 152A and the right plate 152B is close to the tube feed path 9C (refer to FIG. 3).

The lower plate 152C connects lower end portions of the left plate 152A and the right plate 152B. The lower plate 152C is a plate-shaped body having a substantially rectangular shape in a plan view. The lower plate 152C extends from the rear side to the front side of the tube feed path 9C.

As shown in FIG. 6, the first shaft portion 154 is rotatably supported by a lower portion of the left plate 152A and a lower portion of the right plate 152B. The first shaft portion 154 is a shaft portion that extends in the left-right direction. The first shaft portion 154 extends to the right side of the right plate 152B.

The cam drive gear 156 is supported by the right end portion of the first shaft portion 154. The cam drive gear 156 can rotate around the first shaft portion 154. The cam drive gear 156 is positioned to the rear of the rear wall portion 194 (refer to FIG. 2). A second toothed portion 156A is provided around a whole circumferential surface of the cam drive gear 156. The second toothed portion 156A can mesh with the first toothed portion 136A of the intermittent gear 136.

As a result of the second toothed portion 156A meshing with the first toothed portion 136A (refer to FIG. 4), the cam drive gear 156 is caused to rotate by the intermittent gear 136. When the intermittent gear 136 rotates in the second rotation direction (the direction of the arrow A2 in FIG. 4), the cam drive gear 156 rotates in a third rotation direction. The third rotation direction is a direction in which an arrow A3 shown in FIG. 6 is oriented. When the intermittent gear 136 rotates in the first rotation direction (the direction of the arrow A1 in FIG. 4), the cam drive gear 156 rotates in a fourth rotation direction. The fourth rotation direction is a direction in which an arrow A4 shown in FIG. 6 is oriented.

The cam member 158 is supported by the first shaft portion 154, between the left plate 152A and the right plate 152B. The cam member 158 includes a cylindrical portion 159. The cylindrical portion 159 extends in the left-right direction. The first shaft portion 154 is inserted into a tube aperture (refer to FIG. 7) of the cylindrical portion 159. In this way, the cam member 158 rotates around the first shaft portion 154 in concert with the rotation of the cam drive gear 156. The rotation direction of the cam member 158 and the rotation direction of the cam drive gear 156 match each other.

Figure 7:
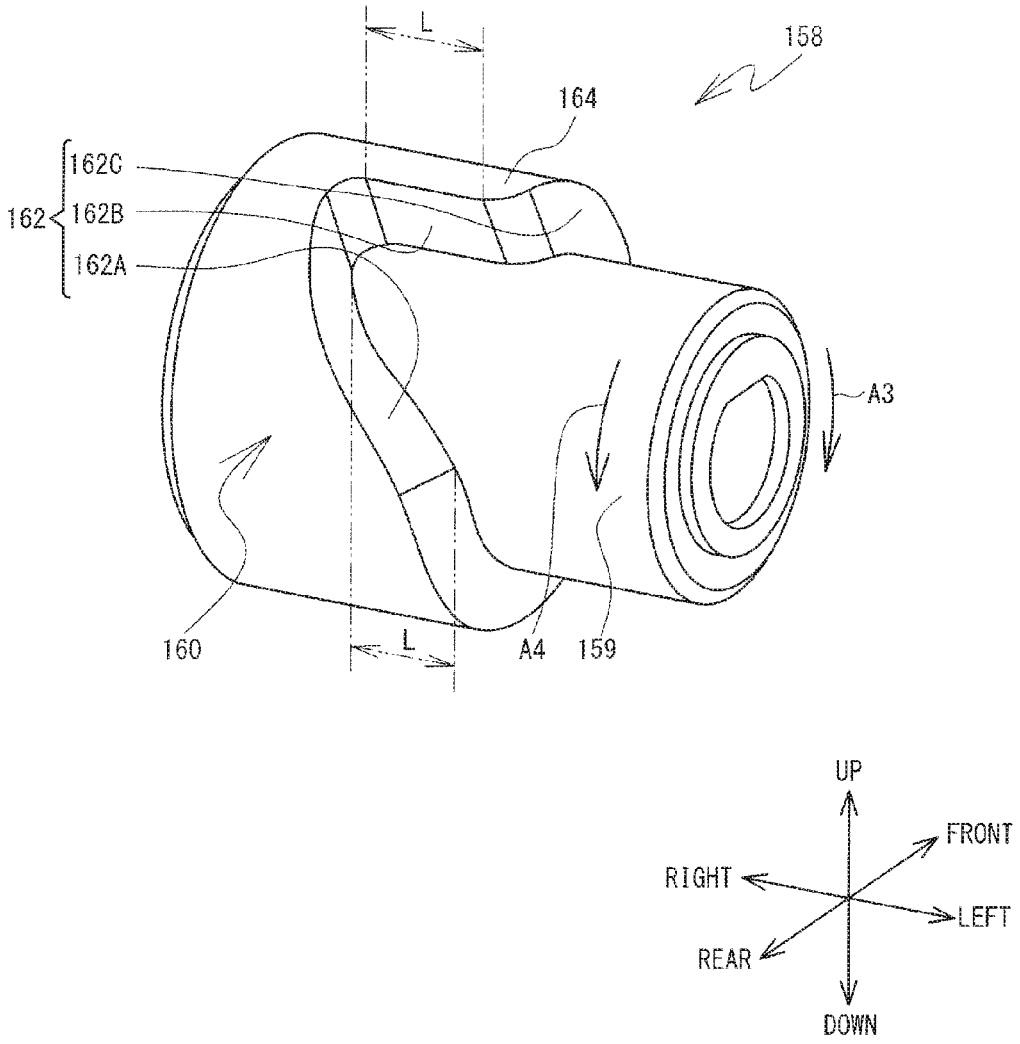
FIG. 7 is a perspective view of a cam member 158.

As shown in FIG. 7, a cam portion 160 is formed on a right portion of the outer circumferential surface of the cylindrical portion 159. The cam portion 160 can rotate with the cylindrical portion 159. The cam portion 160 is formed so as to surround the whole circumferential surface of the right portion of the outer circumferential surface of the cylindrical portion 159. A part of a left portion of the cam portion 160 is cut out toward the right side.

The cam portion 160 includes a cam surface 162. The cam surface 162 is formed on a portion of the surface of the cam portion 160 that faces to the left and portions that face in the fourth rotation direction (the direction of the arrow A4). The cam surface 162 includes a first cam surface 162A, a second cam surface 162B, and a third cam surface 162C.

The first cam surface 162A extends gradually to the left in the fourth rotation direction. Centering on the first shaft portion 154, an angle over which the first cam surface 162A is formed is 82 degrees, for example. The second cam surface 162B is connected to the right end portion of the first cam surface 162A. The second cam surface 162B is a surface that extends in a direction to become separated from the first shaft portion 154 (refer to FIG. 6) and in the left-right direction. A length of the first cam surface 162A in the left-right direction and a length of the second cam surface 162B in the left-right direction are the same as each other, and correspond to a distance L shown in FIG. 7. The third cam surface 162C connects the end portion in the fourth rotation direction of the first cam surface 162A and the left end portion of the second cam surface 162B. The third cam surface 162C is parallel to the third rotation direction and the fourth rotation direction.

A specific cam surface 164 is formed on the outer circumferential surface of the cam portion 160. The specific cam surface 164 is disposed further to the right side than the third cam surface 162C. The specific cam surface 164 extends in the third rotation direction, from the end portion of the second cam surface 162B in the direction in which the second cam surface 162B is separated from the first shaft portion 154.

[2-3-2. Receiving Block Support Portion 150]

Figure 8:
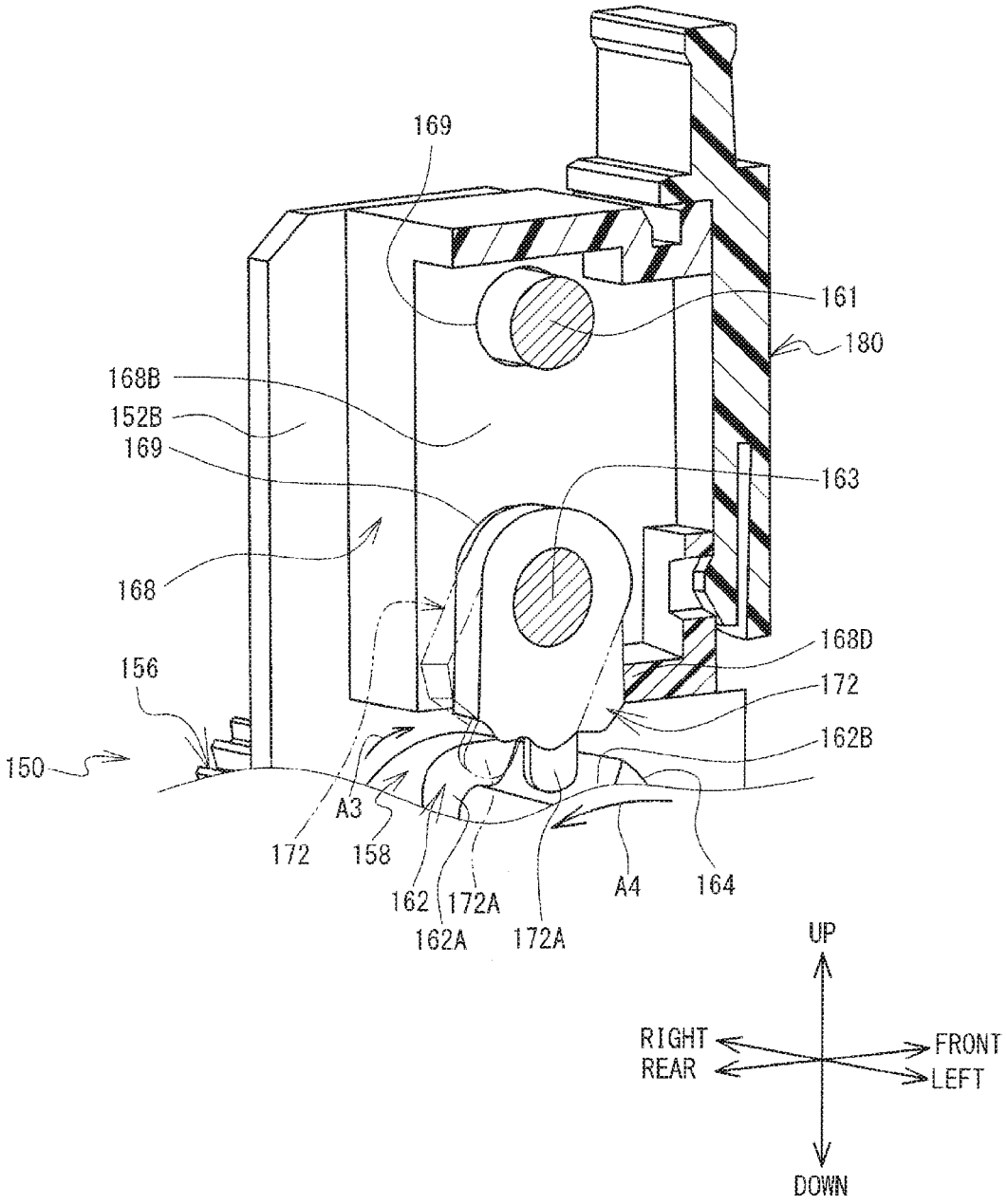
FIG. 8 is a cross-sectional perspective view of a support member 168.

As shown in FIG. 6 and FIG. 8, the receiving block support portion 150 includes support rods 161 and 163, a sliding member 172, and the receiving block 180. The support rods 161 and 163 extend in the left-right direction above the cam member 158. The support rods 161 and 163 are disposed in this order from the upper side. Both ends of each of the support rods 161 and 163 in the left-right direction are fixed, respectively, to the left plate 152A and the right plate 152B.

The support member 168 is supported by the support rods 161 and 163 between the left plate 152A and the right plate 152B such that the support member 168 can move linearly in the left-right direction. The support member 168 is positioned above the cam member 158. The support member 168 is a box shape that is open on the lower side and the rear side.

The support member 168 includes a left wall portion 168A and a right wall portion 168B. The left wall portion 168A and the right wall portion 168B are opposed to each other with a gap between them in the left-right direction. Two hole portions 169 are provided in each of the left wall portion 168A and the right wall portion 168B. The support rods 161 and 163 are respectively inserted through the upper and lower hole portions 169.

Of the two hole portions 169 of the left wall portion 168A, a contact wall portion (not shown in the drawings) is provided on the inside of the upper hole portion 169. The contact wall portion is a plate-shaped body having a thickness in the left-right direction. A circular hole (not shown in the drawings) that is concentric with the hole portion 169 is formed in the contact wall portion. The support rod 161 is inserted into the circular hole.

Figure 13:
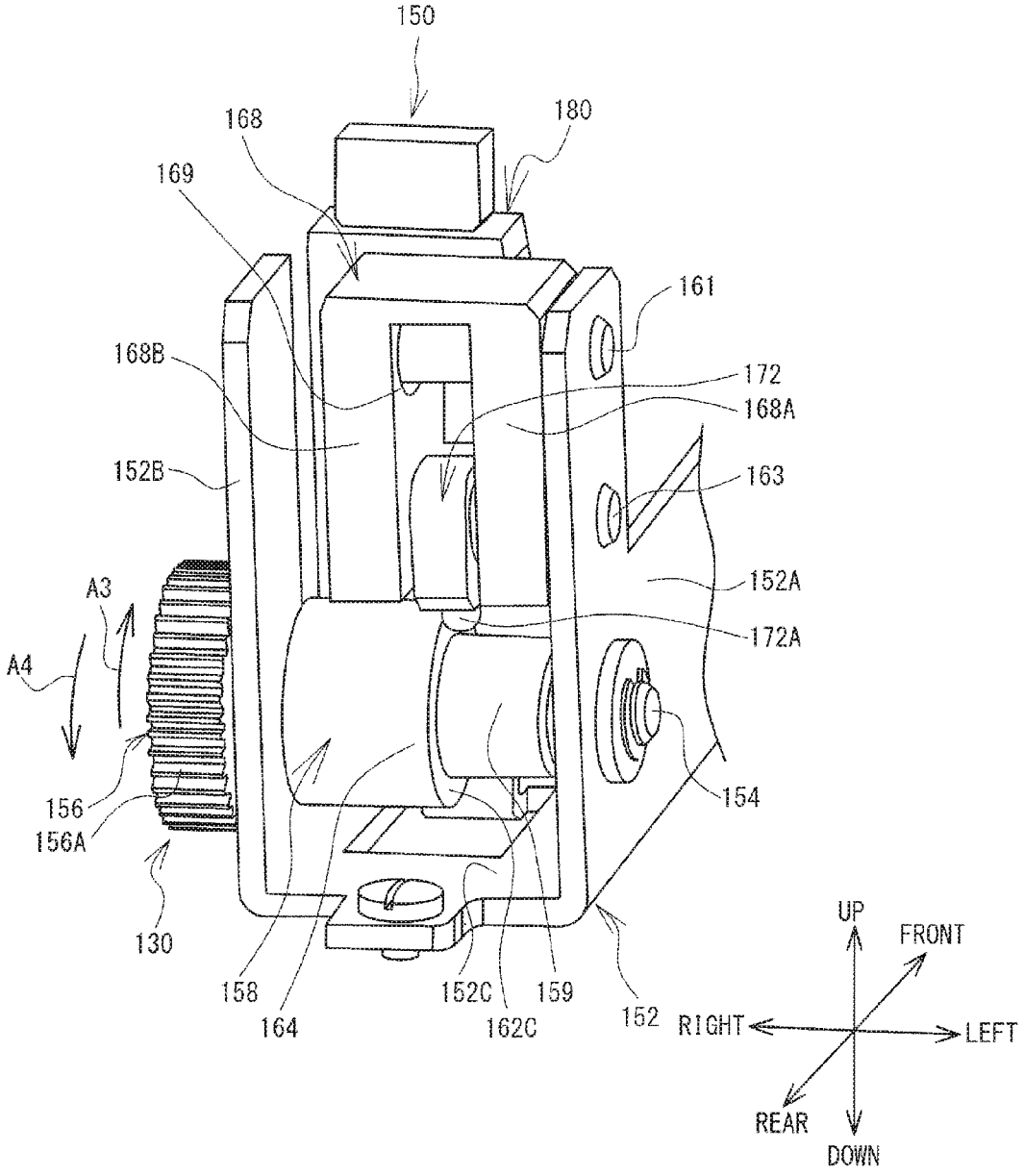
FIG. 13 is a perspective view of the receiving block support portion 150 when the receiving block 180 is in a second opposed position.

The left end position of a movable range of the support member 168 is a position in the left-right direction of the support member 168 when the left wall portion 168A is in contact with the left plate 152A (refer to FIG. 13). The right end position of the movable range of the support member 168 is a position in the left-right direction of the support member 168 when the right wall portion 168B is in contact with the right plate 152B (refer to FIG. 3, FIG. 4, FIG. 6, and so on).

As shown in FIG. 8, the sliding member 172 is rotatably supported by the support rod 163 between the left wall portion 168A (refer to FIG. 6) and the right wall portion 168B. The sliding member 172 is a substantially cuboid shape. A length in the left-right direction of an upper portion of the sliding member 172 is slightly shorter than a distance between the right wall portion 168B and the left wall portion 168A, in the direction in which the right wall portion 168B and the left wall portion 168A are opposed to each other. The sliding member 172 includes a sliding portion 172A. The sliding portion 172A protrudes downward from the support member 168. A lower end portion of the sliding portion 172A is formed in an arc shape toward the lower side. The sliding portion 172A can slide with respect to the cam surface 162 or the specific cam surface 164.

The sliding member 172 can rotate around the support rod 163 between a first rotation position and a second rotation position. The first rotation position is a rotation position of the sliding member 172 when the sliding portion 172A slides with respect to the cam surface 162. When the sliding member 172 is in the first rotation position, the sliding member 172A protrudes downward from the support member 168. The second rotation position is a rotation position of the sliding member 172 when the sliding portion 172A slides with respect to the specific cam surface 164. The second rotation position is a position when the sliding member 172 has rotated slightly further in the clockwise direction, in a left side view, than the first rotation position. In FIG. 8, the sliding member 172 that is in the first rotation position is illustrated with a solid line, and the sliding member 172 that is in the second rotation position is illustrated with a line of alternate long and short dashes.

A regulating portion 168D is provided in front of the sliding member 172 in the first rotation position. The regulating portion 168D protrudes to the left from the front side of a lower portion of the left surface of the right wall portion 168B. The regulating portion 168D comes into contact, from the front, with the sliding member 172 in the first rotation position.

As shown in FIG. 6, the support rods 161 and 163 are respectively inserted through coil springs 171 and 173. The coil spring 171 enters into the hole portion 169 and urges the contact wall portion (not shown in the drawings) to the right. The coil spring 173 passes through the inside of the hole portion 169 and urges the sliding member 172 to the right. When the sliding member 172 that is being urged is in the first rotation position, the movement of the sliding member 172 to the right is restricted by the cam surface 162. When the sliding member 172 that is being urged is in the second rotation position, the movement of the sliding member 172 to the right is restricted by the left surface of the right wall portion 168B.

As shown in FIG. 3, the receiving block 180 is provided on the front end portion of the support member 168. The receiving block 180 is positioned to the left of the rear wall portion 194 (refer to FIG. 2). In other words, the receiving block 180 is provided on the downstream side, in the tube feed direction, of the positioning portion 190. The receiving block 180 is a substantially cuboid shape. A front end surface of the receiving block 180 is a contact surface 183 with which the cutting blade 275 can come into contact. The tube 9 can be disposed on the contact surface 183. In the up-down direction, the contact surface 183 extends from above the reference position P to below the reference position P (refer to FIG. 11A to FIG. 11C and FIG. 15A to FIG. 15C). The reference position P is between the upper end and the lower end of the contact surface 183 in the up-down direction.

The contact surface 183 includes a first contact surface 181 and a second contact surface 182. The first contact surface 181 is provided further to the left than the second contact surface 182. A retraction groove 187, into which a part of the tube 9 in the circumferential direction can enter, is provided in a central portion of the first contact surface 181 in the up-down direction. The retraction groove 187 is provided in a portion of the first contact surface 181 that includes the reference position P in the up-down direction (refer to FIG. 11A to FIG. 11C). The first contact surface 181 includes two contact planes 181A that are formed in a planar shape. Of the first contact surface 181, the two contact planes 181A are a portion above and a portion below the retraction groove 187. The two contact planes 181A extend in the left-right direction and the up-down direction. The two contact planes 181A are in the same plane as each other.

As shown in FIG. 11A to FIG. 11C, the retraction groove 187 is a recessed portion that is recessed toward the rear. The retraction groove 187 is a substantially rectangular shape in a front view. A length of the retraction groove 187 in the front-rear direction is a groove depth of the retraction groove 187. The retraction groove 187 includes a first surface 187A, a second surface 187B, and a third surface 187C. The first surface 187A is a flat surface extending to the rear from a lower end of the upper contact plane 181A of the two contact planes 181A. The second surface 187B is a flat surface extending to the rear from an upper end of the lower contact plane 181A of the two contact planes 181A. A length of the second surface 187B in the front-rear direction is longer than a length of the first surface 187A in the front-rear direction. The third surface 187C is a flat surface that connects a rear end of the first surface 187A and a rear end of the second surface 187B. The third surface 187C forms a groove bottom of the retraction groove 187. The third surface 187C is a flat surface that inclines toward the front in the upward direction. Of the third surface 187C, a section that is above the reference position P extends to the side of the contact plane 181A in the upward direction. A maximum groove depth of the retraction groove 187 of the present example is less than 0.5 mm, for example. The maximum groove depth of the present example is a distance between a lower end of the third surface 187C and the contact plane 181A in the front-rear direction.

As shown in FIG. 4, the second contact surface 182 is a flat surface that extends in the up-down direction and the left-right direction. The second contact surface 182 is in the same plane as the two contact planes 181A.

The receiving block 180 is provided on the support member 168 and can thus move linearly in the left-right direction. The receiving block 180 can move linearly between a first opposed position and a second opposed position. The first opposed position is a position at the right end of a movable range of the receiving block 180. In the present example, when the receiving block 180 is in the first opposed position, the first contact surface 181 is opposed to the cutting blade 275. The second opposed position is a position at the left end of the movable range of the receiving block 180. In the present example, when the receiving block 180 is in the second opposed position, the second contact surface 182 is opposed to the cutting blade 275.

[2-3-3. Positional Relationships of Various Members when Receiving Block Movement Mechanism 120 is in Initial State]

Positional relationships of the intermittent gear 136, the cam member 158, the sliding member 172, the support member 168, and the receiving block 180 when the receiving block movement mechanism 120 having the above-described structure is in an initial state will be explained. The initial state of the receiving block movement mechanism 120 is a state of the receiving block movement mechanism 120 before the cutting mechanism 100 starts the cutting operation.

When the receiving block movement mechanism 120 is in the initial state, the intermittent gear 136 is in a start rotation position (refer to FIG. 4). The start rotation position is a rotation position of the intermittent gear 136 when the intermittent gear 136 has slightly rotated in the first rotation direction from a rotation position at which the first end portion 136B meshes with the second toothed portion 156A. The intermittent gear 136 that is in the start rotation position does not mesh with the cam drive gear 156. Thus, transmission of the driving force of the DC motor 104 to the cam drive gear 156 is restricted.

When the receiving block movement mechanism 120 is in the initial state, the cam member 158 is in a rotation position such that the second cam surface 162B is disposed substantially above the first shaft portion 154 (refer to FIG. 6). When the receiving block movement mechanism 120 is in the initial state, the sliding member 172 is in the first rotation position (refer to FIG. 8). The sliding portion 172A of the sliding member 172 is pressed against the right end portion of the first cam surface 162A, by the urging force of the coil spring 173 (refer to FIG. 6). At that time, an upper portion of the sliding member 172 is in contact with the left surface of the right wall portion 168B. The support member 168 is at the right end position of the movable range of the support member 168 and is urged by the coil spring 171. The movement of the support member 168 to the right is restricted by the right plate 152B. At that time, the receiving block 180 is in the first opposed position (refer to FIG. 3).

[2-3-4. Overview of Operations of Receiving Block Movement Mechanism 120]

When the receiving block movement mechanism 120 is in the initial state, if the DC motor 104 rotates in the forward direction, the intermittent gear 136 (refer to FIG. 4) rotates in the first rotation direction (the direction of the arrow A1). Thus, the intermittent gear 136 idles, without meshing with the cam drive gear 156. As a result, the receiving block movement mechanism 120 inhibits the transmission of the driving force of the DC motor 104 to the cam drive gear 156.

On the other hand, when the receiving block movement mechanism 120 is in the initial state, if the DC motor 104 rotates in the reverse direction, the intermittent gear 136 (refer to FIG. 4) rotates in the second rotation direction (the direction of the arrow A2). Immediately after the intermittent gear 136 has started to rotate in the second rotation direction, the first end portion 136B of the first toothed portion 136A meshes with the second toothed portion 156A. The receiving block movement mechanism 120 allows the transmission of the driving force of the DC motor 104 to the cam drive gear 156. By the intermittent gear 136 continuously rotating in the second rotation direction, the cam drive gear 156 is caused to rotate in the third rotation direction (the direction of the arrow A3 in FIG. 6). The cam drive gear 156 causes the first shaft portion 154 (refer to FIG. 6) to rotate in the third rotation direction. In this way, the cam member 158 rotates in the third rotation direction. The first cam surface 162A that is rotating in the third rotation direction slides with respect to the sliding portion 172A. In this way, the sliding member 172 moves to the left while resisting the urging force of the coil spring 173. The sliding member 172 moves to the left in a state in which the rotation of the sliding member 172 in the anti-clockwise direction in a left side view is restricted by the regulating portion 168D (refer to FIG. 8). The sliding member 172 that moves to the left urges the support member 168 to the left. The support member 168 moves to the left from the right end position of the movable range of the support member 168, while resisting the urging force of the coil spring 171. The receiving block 180 moves to the left from the first opposed position.

[2-4. Cutting Blade Movement Mechanism 200]

The cutting blade movement mechanism 200 will be explained with reference to FIG. 3 and FIG. 9. The cutting blade movement mechanism 200 includes a rotation drive portion 210 and a cutting blade movement portion 270. The rotation drive portion 210 is rotationally driven in concert with the rotation of the DC motor 104. The cutting blade movement portion 270 moves the cutting blade 275 in the front-rear direction in accordance with the rotational driving of the rotation drive portion 210.

[2-4-1. Rotation Drive Portion 210]

The rotation drive portion 210 includes a cam portion 215, an initial position sensor 241, an intermediate position sensor 242, and a link member 220. The cam portion 215 is a portion formed on a left portion of the above-described rotating member 106 (refer to FIG. 5). The cam portion 215 is circular in a left side view. The cam portion 215 can rotate around the rotating shaft portion 103 together with the first gear portion 109 (refer to FIG. 5). Hereinafter, the anti-clockwise direction around the rotating shaft portion 103 in a left side view is referred to as a first direction and the opposite direction to the first direction is referred to as a second direction. The first direction is a direction in which an arrow B1 shown in FIG. 9 is oriented. The second direction is a direction in which an arrow B2 shown in FIG. 9 is oriented. When the DC motor 104 rotates in the forward direction, the cam portion 215 rotates in the first direction. When the DC motor 104 rotates in the reverse direction, the cam portion 215 rotates in the second direction.

The cam portion 215 includes a right side protruding portion 211 and a left side protruding portion 212. The right side protruding portion 211 and the left side protruding portion 212 are both plate-shaped bodies that protrude to the outside, in a radial direction, from the circumferential surface of the cam portion 215.

The right side protruding portion 211 is provided further to the right side (namely, to the far side of FIG. 9) than a center in the left-right direction of the circumferential surface of the cam portion 215. The right side protruding portion 211 is provided on a part of the circumferential surface of the cam portion 215 in a rotational direction around the rotating shaft portion 103. An angle over which the right side protruding portion 211 is formed is an angle, in the first direction, from the end portion of the right side protruding portion 211 in the second direction to the end portion of the right side protruding portion 211 in the first direction. The angle over which the right side protruding portion 211 is formed in the present example is 90 degrees or more. The end surface of the right side protruding portion 211 in the second direction is inclined so as to separate from the rotating shaft portion 103 in the first direction.

The left side protruding portion 212 is provided further to the left side (namely, to the near side of FIG. 9) than the center in the left-right direction of the circumferential surface of the cam portion 215. Therefore, the left side protruding portion 212 is disposed further to the left side than the right side protruding portion 211. The left side protruding portion 212 is provided on a part of the circumferential surface of the cam portion 215 in the rotational direction around the rotating shaft portion 103. An angle over which the left side protruding portion 212 is formed in the present example is smaller than the angle over which the right side protruding portion 211 is formed. The angle over which the left side protruding portion 212 is formed is an angle, in the first direction, from the end portion of the left side protruding portion 212 in the second direction to the end portion of the left side protruding portion 212 in the first direction. The end surface of the left side protruding portion 212 in the second direction is inclined so as to separate from the rotating shaft portion 103 in the first direction. The end surface of the left side protruding portion 212 in the first direction is inclined so as to separate from the rotating shaft portion 103 in the second direction. The end surface of the left side protruding portion 212 in the second direction is further to the first direction side than the end surface of the right side protruding portion 211 in the second direction.

A pressing pin 215A is provided on a left surface of the cam portion 215. The pressing pin 215A is a columnar body that protrudes to the left from the cam portion 215. The pressing pin 215A is disposed in a position at substantially 90 degrees in the second direction with respect to the end surface in the second direction of the right side protruding portion 211.

The cam portion 215 shown in FIG. 3 and FIG. 9 is in an initial rotation position. When the cam portion 215 is in the initial rotation position, the pressing pin 215A is in a rotation position in which the pressing pin 215A has rotated slightly in the first direction from a rotation position directly above the rotating shaft portion 103.

As shown in FIG. 9, the initial position sensor 241 is provided on a lower rear portion of a left surface of the first plate portion 102A. The initial position sensor 241 includes a first rotating shaft (not shown in the drawings), a movable portion 241A, and a first spring (not shown in the drawings). The first rotating shaft extends in the left-right direction in an upper rear portion inside the initial position sensor 241. The movable portion 241A is rotatably provided on the first rotating shaft. The movable portion 241A extends from the first rotating shaft downward and to the front. Of the movable portion 241A, the end portion on the opposite side to the first rotating shaft is a leading end portion of the movable portion 241A. The leading end portion of the movable portion 241A is curved in an arc shape toward the rotating shaft portion 103. The first spring urges the movable portion 241A in the anti-clockwise direction in a left side view around the first rotating shaft.

The movable portion 241A comes into contact with or is separated from the right side protruding portion 211 that rotates. When the movable portion 241A is separated from the right side protruding portion 211, the movable portion 241A is in a normal position. When the movable portion 241A is in the normal position, the leading end portion of the movable portion 241A enters into a movement path of the right side protruding portion 211. In this case, the initial position sensor 241 outputs an OFF signal. When the movable portion 241A comes into contact with the right side protruding portion 211, the movable portion 241A is further in the clockwise direction in a left side view than the normal position. In this case, the initial position sensor 241 outputs an ON signal. When the cam portion 215 is in the initial rotation position, the end surface in the second direction of the right side protruding portion 211 is slightly separated, in the first direction, from the leading end portion of the movable portion 241A. Thus, when the cam portion 215 is in the initial rotation position, the initial position sensor 241 outputs the OFF signal.

The intermediate position sensor 242 is provided on an upper rear portion on the left surface of the first plate portion 102A. The intermediate position sensor 242 is positioned substantially 90 degrees in the second direction from the initial position sensor 241. The intermediate position sensor 242 is disposed further to the left side than the initial position sensor 241. The intermediate position sensor 242 includes a second rotating shaft (not shown in the drawings), a movable portion 242A, and a second spring (not shown in the drawings). The second rotating shaft extends in the left-right direction in a lower rear portion inside the intermediate position sensor 242. The movable portion 242A is rotatably provided on the second rotating shaft. The movable portion 242A extends from the second rotating shaft upward and to the front. Of the movable portion 242A, the end portion on the opposite side to the second rotating shaft is a leading end portion of the movable portion 242A. The leading end portion of the movable portion 242A is curved in an arc shape toward the rotating shaft portion 103. The second spring urges the movable portion 242A in the clockwise direction, in a left side view, around the second rotating shaft.

The movable portion 242A comes into contact with or is separated from the left side protruding portion 212 that rotates. When the movable portion 242A is separated from the left side protruding portion 212, the movable portion 242A is in a normal position. When the movable portion 242A is in the normal position, the leading end portion of the movable portion 242A enters into a movement path of the left side protruding portion 212. In this case, the intermediate position sensor 242 outputs an OFF signal. When the movable portion 242A comes into contact with the left side protruding portion 212, the movable portion 242A is further in the anti-clockwise direction in a left side view than the normal position. In this case, the intermediate position sensor 242 outputs an ON signal. When the cam portion 215 is in the initial rotation position, the end surface in the second direction of the left side protruding portion 212 is separated from the leading end portion of the movable portion 242A, at a position of having rotated 90 degrees or more in the first direction from the leading end portion of the movable portion 242A. The end surface of the left side protruding portion 212 in the first direction is separated from the leading end portion of the movable portion 242A, at a position of having rotated 90 degrees or more in the second direction from the leading end portion of the movable portion 242A. Thus, when the cam portion 215 is in the initial rotation position, the intermediate position sensor 242 outputs the OFF signal.

The link member 220 is a plate-shaped member that is substantially L-shaped in a right side view. The link member 220 is provided further to the left side than the gear group 105 and the cam portion 215. The link member 220 can rotate around a link shaft portion 223. The link shaft portion 223 extends in the left-right direction. The right end portion of the link shaft portion 223 is fixed to the left surface of the first plate portion 102A. Hereinafter, the anti-clockwise direction, in a left side view, around the link shaft portion 223 is referred to as a third direction, and a direction opposite to the third direction is referred to as a fourth direction. The third direction is a direction in which an arrow B3 shown in FIG. 9 is oriented. The fourth direction in a direction in which an arrow B4 shown in FIG. 9 is oriented.

As shown in FIG. 9, the link member 220 includes a first plate-shaped portion 221 and a second plate-shaped portion 222. The first plate-shaped portion 221 is a plate-shaped portion that extends substantially in the front-rear direction below the tube feed path 9C. The second plate-shaped portion 222 is a plate-shaped portion that extends upward from a front end portion of the first plate-shaped portion 221 while inclining at substantially 90 degrees with respect to the first plate-shaped portion 221. An upper end portion of the second plate-shaped portion 222 is disposed to the front of the tube feed path 9C. A rear lower portion of the second plate-shaped portion 222 is connected to the left end portion of the link shaft portion 223.

A spring 220A is provided on the link shaft portion 223. The link member 220 is urged in the fourth direction around the link shaft portion 223 by the spring 220A. The rotation in the fourth direction of the link member 220 that is urged is restricted at a position at which a link protrusion 224 comes into contact with the above-described plate body 99. The link protrusion 224 is a protruding portion that protrudes diagonally upward and to the rear from a front portion of an upper surface of the first plate-shaped portion 221. Hereinafter, a rotation position of the link member 220 when the link protrusion 224 is in contact with the plate body 99 is referred to as a separated rotation position. The link member 220 shown in FIG. 3, FIG. 4, and FIG. 9 is in the separated rotation position.

A spring shaft portion 226, latching pieces 225 and 227, and an escape groove 228 are provided in the first plate-shaped portion 221. The spring shaft portion 226 protrudes to the left from a left surface of the first plate-shaped portion 221. The spring shaft portion 226 is disposed below the link protrusion 224.

The latching pieces 225 and 227 protrude to the front from the first plate-shaped portion 221. The latching piece 225 is provided on a rear end portion on the upper surface of the first plate-shaped portion 221. The latching piece 225 is disposed further to the rear than the spring shaft portion 226. The latching piece 227 is provided on a portion further to the rear than a center, in the front-rear direction, of a lower surface of the first plate-shaped portion 221. A position of the latching piece 227 in the front-rear direction is between the latching piece 225 and the spring shaft portion 226. The escape groove 228 is provided between the latching piece 225 and the link protrusion 224, in the upper surface of the first plate-shaped portion 221. The escape groove 228 is a groove portion that is recessed downward. A central portion of the escape groove 228 in the front-rear direction is formed below the latching piece 225.

A torsion spring 235, which is in an elastically deformed state, is provided on the first plate-shaped portion 221. The torsion spring 235 includes a coil portion 233, a first arm portion 231, and a second arm portion 232. An axial line of the coil portion 233 extends in the left-right direction. The spring shaft portion 226 is inserted into the coil portion 233.

The first arm portion 231 extends to the rear from the right end portion of the coil portion 233. A leading end portion of the first arm portion 231 urges the latching piece 225 from below, and latches with the latching piece 225. The first arm portion 231 is disposed below the pressing pin 215A of the cam portion 215. The leading end portion of the rotating pressing pin 215A comes into contact with or separates from the first arm portion 231. The second arm portion 232 extends to the rear from the left end portion of the coil portion 233. The second arm portion 232 is disposed below the first arm portion 231. A leading end portion of the second arm portion 232 urges the latching piece 227 from above, and latches with the latching piece 227.

A protruding pin 238 is provided on the second plate-shaped portion 222. The protruding pin 238 protrudes to the right from an upper end portion of the second plate-shaped portion 222. When the link member 220 is in the separated rotation position, the protruding pin 238 is positioned to a front end position in a movable range of the protruding pin 238.

[2-4-2. Cutting Blade Movement Portion 270]

As shown in FIG. 3, FIG. 4, and FIG. 9, the cutting blade movement portion 270 includes a housing member 272, a rail member 274, the cutting blade 275 (refer to FIG. 11A to FIG. 11C), and an arm member 277. The housing member 272 is placed on a front portion of the lower plate 152C of the holding member 152. The housing member 272 is opposed to the receiving block 180 from the front side of the receiving block 180. The housing member 272 is positioned further downstream, in the tube feed direction, than the positioning portion 190 (refer to FIG. 2). The housing member 272 is a box-shaped member that is open to the rear. The housing member 272 can move in the front-rear direction. A through hole 272A is provided in an upper portion of a front wall portion of the housing member 272.

The rail member 274 is a columnar body that extends in the front-rear direction while penetrating a lower portion of the housing member 272. The rail member 274 is provided below the tube feed path 9C. The rail member 274 guides the movement of the housing member 272 in the front-rear direction.

The cutting blade 275 is housed inside the housing member 272. The cutting blade 275 is a plate-shaped body having a thickness in the left-right direction. A blade portion 275A (refer to FIG. 11A to FIG. 11C), which extends in a straight line in the up-down direction, is formed on a rear end portion of the cutting blade 275. The cutting blade 275 is urged to the front by an attachment spring (not shown in the drawings) provided inside the housing member 272. The cutting blade 275 can move in the front-rear direction relative to the housing member 272. The blade portion 275A can protrude further to the rear than the housing member 272.

The arm member 277 extends in the front-rear direction. The arm member 277 is inserted into the through hole 272A. A rear end portion of the arm member 277 is coupled to the cutting blade 275. A tubular portion 277A is formed on a front end portion of the arm member 277. The tubular portion 277A is an elliptical shape that is long in the up-down direction in a right side view. The protruding pin 238 of the link member 220 is inserted into a tubular hole 277B of the tubular portion 277A from the left side. In this way, when the link member 220 rotates around the link shaft portion 223, the arm member 277 can move in the left-right direction.

[2-4-3. Positional Relationships of Various Members when Cutting Blade Movement Mechanism 200 is in Initial State]

Positional relationships of the cam portion 160, the link member 220, the housing member 272, and the cutting blade 275 when the cutting blade movement mechanism 200 having the above-described structure is in an initial state will be explained. The initial state of the cutting blade movement mechanism 200 is a state of the cutting blade movement mechanism 200 before the cutting mechanism 100 starts the cutting operation.

When the cutting blade movement mechanism 200 is in the initial state, the cam portion 160 is in the initial rotation position, and the link member 220 is in the separated rotation position. In this case, the leading end portion of the pressing pin 215A of the cam portion 215 is in contact, from above, with the first arm portion 231 of the torsion spring 235. Since the link member 220 is in the separated rotation position, the protruding pin 238 is in the front end position of its movable range. The arm member 277 and the housing member 272 are at front end positions of their respective movable ranges. An arrangement position of the cutting blade 275 when the housing member 272 is in the front end position of its movable range is referred to as a separated position. The separated position is a front end position of a movable range of the cutting blade 275. When the cutting blade 275 is in the separated position, the cutting blade 275 is separated from the contact surface 183 of the receiving block 180, and is housed inside the housing member 272.

[2-4-4. Overview of Operations of Cutting Blade Movement Mechanism 200]

As shown in FIG. 9, when the cutting blade movement mechanism 200 is in the initial state, if the DC motor 104 rotates in the forward direction, the cam portion 215 rotates in the first direction (the direction of the arrow B1). In accordance with the rotation in the first direction of the cam portion 215, the pressing pin 215A presses the first arm portion 231 in the anti-clockwise direction in a left side view. The link member 220 rotates in the third direction (the direction of the arrow B3). The protruding pin 238 of the link member 220 causes the arm member 277 to move to the rear. The arm member 277 causes the cutting blade 275 to move to the rear. Thus, the housing member 272 moves to the rear from the front end position of the movable range of the housing member 272.

On the other hand, when the cutting blade movement mechanism 200 is in the initial state, if the DC motor 104 rotates in the reverse direction, the cam portion 215 rotates in the second direction (the direction of the arrow B2 in FIG. 9). The link member 220 is maintained in the state of being positioned in the separated rotation position.

In accordance with the rotation of the cam portion 215 in the second direction, the pressing pin 215A separates from the first arm portion 231 and rotates in the second direction. The cam portion 215 rotates to a specific rotation position. In FIG. 9, the pressing pin 215A that has rotated to the specific rotation position is illustrated by a line of alternate long and short dashes. The specific rotation position is a position that is substantially symmetrical with the initial rotation position with respect to a virtual plane T. The virtual plane T includes an axial line of the rotating shaft portion 103, and is a virtual surface that extends in the left-right direction and the up-down direction. When the cam portion 215 rotates to the specific rotation position, the pressing pin 215A once more comes into contact with the first arm portion 231. A position at which the pressing pin 215A comes into contact with the first arm portion 231 is closer to the coil portion 233 than the case in which the DC motor 104 rotates in the forward direction.

When the DC motor 104 continues to rotate in the reverse direction, the cam portion 215 rotates further in the second direction than the specific rotation position. The pressing pin 215A presses the first arm portion 231 in the anti-clockwise direction in a left side view. The link member 220 rotates in the third direction and causes the housing member 272 to move to the rear from the front end position of the movable range of the housing member 272.

[3. Cutting Operations of Cutting Mechanism 100]

Hereinafter, the cutting operations of the cutting mechanism 100 will be explained, as a half cut operation of the tube 9 and a full cut operation of the tube 9. Before the cutting mechanism 100 starts the cutting operation, the cutting mechanism 100 is in an initial state. When the cutting mechanism 100 is in the initial state, the receiving block movement mechanism 120 is in the initial state, and the cutting blade movement mechanism 200 is in the initial state. The initial position sensor 241 and the intermediate position sensor 242 are outputting the OFF signals. When the cutting mechanism 100 is in the initial state, the tube 9 may be positioned on the bottom wall portion 192 of the positioning portion 190 by the user. The tube 9 is disposed on the contact surface 183 (refer to FIG. 3) in a state in which the lower end of the tube 9 is positioned on the reference position P.

[3-1. Half Cut Operation of Cutting Mechanism 100]

An operation in which the cutting mechanism 100 performs a half cut of the large diameter tube 9A will be explained with reference to FIG. 4, FIG. 6, FIG. 9, FIG. 10, and FIG. 11A to FIG. 11C. In each of the FIG. 11A to FIG. 11C, FIG. 12A to 12C, and FIG. 15A to FIG. 15C, the receiving block 180, the cutting blade 275, and the tube 9 are illustrated schematically in cross-section as seen from the left side. In FIG. 11A to FIG. 11C, FIG. 12A to FIG. 12C, and FIG. 15A to FIG. 15C, hatching of the rear end portion of the cutting blade 275 is not illustrated.

The half cut operation of the large diameter tube 9A is as follows. The cutting mechanism 100 clamps the large diameter tube 9A between the first contact surface 181 and the cutting blade 275, while the receiving block 180 is maintained in a state of being stopped in the first opposed position. The cutting blade 275 presses the large diameter tube 9A toward the first contact surface 181 and thus performs the half cut of the large diameter tube 9A. In accordance with a driving control of the CPU 41 (refer to FIG. 16) of the control board 19 (refer to FIG. 2), the DC motor 104 is driven in the following manner.

While the cutting mechanism 100 is in the initial state, the DC motor 104 rotates in the forward direction. The intermittent gear 136 that is in the start rotation position does not mesh with the cam drive gear 156 and idles in the first rotation direction (the direction of the arrow A1 in FIG. 4). As shown in FIG. 6, while the support member 168 is urged to the right by the coil springs 171 and 173, the support member 168 is maintained in a state of being stopped at the right end position of its movable range. Thus, the receiving block 180 is maintained in the state of being stopped in the first opposed position.

Figure 10:
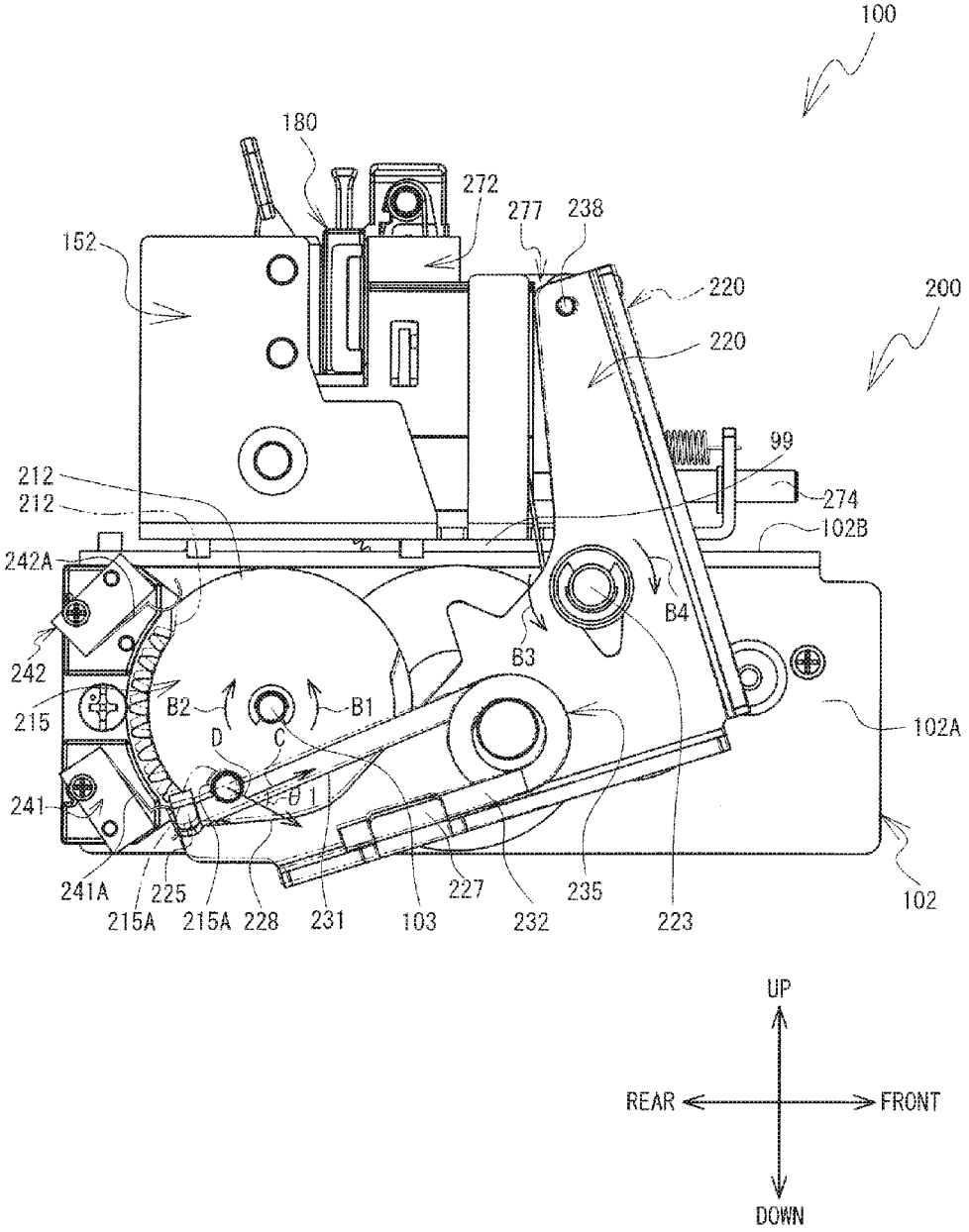
FIG. 10 is a left side view of the cutting mechanism 100 at a time of ending a half cut operation.

As shown in FIG. 9 and FIG. 10, when the intermittent gear 136 that is in the start rotation position rotates in the first rotation direction, the cam portion 215 rotates in the first direction (the direction of the arrow B1). The housing member 272 moves to the rear from the front end portion of its movable range. The cutting blade 275 moves to the rear from the separated position (refer to FIG. 11A).

Although not shown in the drawings, the housing member 272 that moves to the rear comes into contact with the large diameter tube 9A, from the front, ahead of the cutting blade 275. The movement of the housing member 272 to the rear is restricted. When the DC motor 104 continues to rotate in the forward direction, the arm member 277 urges the cutting blade 275 to the rear. The cutting blade 275 moves to the rear, relative to the housing member 272, while resisting the urging force of the attachment spring (not shown in the drawings).

As shown in FIG. 10 and FIG. 11B, the blade portion 275A moves to a clamping position. The clamping position of the present example is an arrangement position of the cutting blade 275 when the large diameter tube 9A is clamped between the blade portion 275A and the contact surface 183. When the half cut operation is performed, the cutting blade 275 that is in the clamping position clamps the large diameter tube 9A between the cutting blade 275 and the first contact surface 181. The large diameter tube 9A is elastically deformed between the cutting blade 275 and the first contact surface 181 and becomes a substantially elliptical shape that is long in the up-down direction in a left side view.

A rotation position of the link member 220 that has caused the cutting blade 275 to move to the clamping position is a clamping rotation position. When the half cut operation is performed, a rotation position of the cam portion 215 that has caused the link member 220 to move to the clamping rotation position is a first intermediate rotation position. In FIG. 10, the link member 220 that is in the clamping rotation position and the cam portion 215 that is in the first intermediate rotation position are illustrated by lines of alternate long and short dashes.

When the cam portion 215 that rotates in the first direction rotates from the initial rotation position to the first intermediate rotation position, the end surface of the left side protruding portion 212 in the first direction comes into contact with the movable portion 242A of the intermediate position sensor 242. The intermediate position sensor 242 outputs the ON signal instead of the OFF signal. In this way, the CPU 41 (refer to FIG. 16) of the control board 19 (refer to FIG. 2) can determine that the cam portion 215 has rotated to the first intermediate rotation position.

By the DC motor 104 further rotating continuously in the forward direction for a specified period of time, the cam portion 215 rotates further to the first direction side than the first intermediate rotation position. The pressing pin 215A presses the first arm portion 231. The first arm portion 231 is pressed in the anti-clockwise direction, in a left side view, around the spring shaft portion 226. The first arm portion 231 separates slightly downward from the latching piece 225, and an amount of elastic deformation of the torsion spring 235 increases. The torsion spring 235 urges the link member 220 in the third direction, via the second arm portion 232 and the latching piece 227. As a result, the cutting blade 275 is urged to the rear.

When the amount of elastic deformation of the torsion spring 235 increases at the time of the half cut operation, a pressing angle of the pressing pin 215A against the first arm portion 231 is an acute angle. The pressing angle is a tangential direction of the pressing pin 215A (a direction of an arrow D) with respect to a direction approaching the coil portion 233 (a direction of an arrow C), of an extending direction of the first arm portion 231. The tangential direction of the pressing pin 215A (the direction of the arrow D) is a direction of a line that orthogonally intersects, at a center of the pressing pin 215A, a line linking a center of the rotating shaft portion 103 and the center of the pressing pin 215A, in a left side view. The pressing angle when the half cut operation is performed corresponds to an angle θ1 shown in FIG. 10.

The cutting blade 275 that is being urged moves to a contact position (refer to FIG. 11C) while cutting through the large diameter tube 9A. The contact position is an arrangement position of the cutting blade 275 when the blade portion 275A is in contact with the contact surface 183. The contact position is a rear end position of the movable range of the cutting blade 275. When the half cut operation is performed, the blade portion 275A that has moved to the contact position is in contact with each of the two contact planes 181A. The large diameter tube 9A is half cut by leaving a portion of the large diameter tube 9A that has entered into the retraction groove 187 and has escaped from the cutting blade 275. The blade portion 275A that has moved to the contact position is opposed to the third surface 187C, with the large diameter tube 9A therebetween.

A rotation position of the link member 220 that has caused the cutting blade 275 to move to the contact position is a contact rotation position. When the half cut operation is performed, a rotation position of the cam portion 215 that has caused the link member 220 to move to the contact rotation position is a first final rotation position. In FIG. 10, the link member 220 that is in the contact rotation position and the cam portion 215 that is in the first final rotation position are illustrated with solid lines. When the cam portion 215 rotates from the initial rotation position to the first final rotation position, the rotation of the DC motor 104 in the forward direction is stopped. When the cam portion 215 is in the first final rotation position, the left side protruding portion 212 is in contact with the movable portion 242A.

When the rotation of the DC motor 104 in the forward direction is stopped, the rotation of the intermittent gear 136 in the first rotation direction is stopped. When the half cut operation is performed, while the cutting blade 275 is moving from the separated position to the contact position, the intermittent gear 136 rotates in the first rotation direction by a first specified rotation angle. The first specified rotation angle is smaller than the toothed portion non-formation angle. The first specified rotation angle of the present example is 190 degrees. While the cutting blade 275 is moving from the separated position to the contact position, the intermittent gear 136 does not mesh with the cam drive gear 156 and idles.

While the cutting blade 275 is moving from the separated position to the contact position, the right side protruding portion 211 does not come into contact with the movable portion 241A of the initial position sensor 241, and rotates in the first direction. Thus, while the cutting blade 275 is moving from the separated position to the contact position, the initial position sensor 241 outputs the OFF signal.

After the rotation of the DC motor 104 in the forward direction has stopped, the rotation direction is switched and the DC motor 104 rotates in the reverse direction. The cam portion 215 rotates in the second direction (the direction of the arrow B2 in FIG. 10). The link member 220 rotates in the fourth direction (the direction of the arrow B4 in FIG. 10) from the contact rotation position. The intermittent gear 136 rotates in the second rotation direction (the direction of the arrow A2 in FIG. 4).

When the cam portion 215 rotates to the initial rotation position (refer to FIG. 9) via the first intermediate rotation position, the link member 220 rotates to the separated rotation position via the clamping rotation position. The cutting blade 275 moves to the separated position (refer to FIG. 11A) via the clamping position (refer to FIG. 11B).

The DC motor 104 continues to rotate in the reverse direction. In the state in which the link member 220 is positioned in the separated position, the cam portion 215 rotates slightly in the second direction from the initial rotation position. The end surface of the right side protruding portion 211 in the second direction comes into contact with the movable portion 241A of the initial position sensor 241. The initial position sensor 241 outputs the ON signal instead of the OFF signal. The DC motor 104 switches the rotation direction and once more rotates in the forward direction. When the cam portion 215 returns to the initial rotation position, the right side protruding portion 211 separates from the movable portion 241A. The initial position sensor 241 outputs the OFF signal instead of the ON signal. In this manner, the CPU 41 of the control board 19 determines that the cam portion 215 has returned to the initial rotation position, and stops the rotation of the DC motor 104. At that time, the intermittent gear 136 has returned to the start rotation position. As a result of the above operations, the cutting mechanism 100 returns to the initial state after performing the half cut of the large diameter tube 9A.

The half cut operation of the small diameter tube 9B by the cutting mechanism 100 will be explained with reference to FIG. 9, FIG. 10, and FIG. 12A to FIG. 12C. The half cut operation of the small diameter tube 9B is similar to the half cut operation of the large diameter tube 9A. Hereinafter, an explanation of operations that are the same as those of the half cut operation of the large diameter tube 9A will be simplified.

While the cutting mechanism 100 is in the initial state, the DC motor 104 rotates in the forward direction. The receiving block 180 is maintained in the state of being stopped in the first opposed position. When the cam portion 215 rotates to the first intermediate rotation position from the initial rotation position, the intermediate position sensor 242 outputs the ON signal instead of the OFF signal. At that time, the link member 220 has rotated to the clamping rotation position from the separated rotation position, and the cutting blade 275 has moved from the separated position (refer to FIG. 12A) to the clamping position (refer to FIG. 12B). The small diameter tube 9B is smaller than the large diameter tube 9A. Therefore, the small diameter tube 9B that is between the cutting blade 275 in the clamping position and the first contact surface 181 is only slightly elastically deformed.

After the intermediate position sensor 242 has output the ON signal, the DC motor 104 rotates further in the forward direction for a specified period of time. The cam portion 215 rotates further in the first direction from the first intermediate rotation position. The link member 220 rotates further in the third direction from the clamping rotation position, and urges the cutting blade 275 toward the first contact surface 181. The cutting blade 275 presses the small diameter tube 9B further toward the first contact surface 181. The cutting blade 275 moves from the clamping position to the contact position while cutting through the small diameter tube 9B. The small diameter tube 9B is half cut by leaving a portion of the small diameter tube 9B that has entered into the retraction groove 187.

After the cutting blade 275 has moved to the contact position, the rotation of the DC motor 104 in the forward direction is stopped. After that, the rotation direction is switched and the DC motor 104 rotates in the reverse direction. The DC motor 104 performs the same rotation operations as when the large diameter tube 9A is half cut. The cutting mechanism 100 returns to the initial state.

[3-2. Full Cut Operation of Cutting Mechanism 100]

The full cut operation of the large diameter tube 9A by the cutting mechanism 100 will be explained with reference to FIG. 3, FIG. 4, FIG. 6 to FIG. 9, FIG. 13, FIG. 14, and FIG. 15A to FIG. 15C. An overview of the full cut operation of the large diameter tube 9A is as follows. The cutting mechanism 100 causes the receiving block 180 to move to the second opposed position from the first opposed position, and clamps the large diameter tube 9A between the second contact surface 182 and the cutting blade 275. The cutting blade 275 presses the large diameter tube 9A toward the second contact surface 182 and thus performs a full cut of the large diameter tube 9A. In accordance with a driving control of the CPU 41 (refer to FIG. 16) of the control board 19 (refer to FIG. 2), the DC motor 104 is driven in the following manner.

The DC motor 104 rotates in the reverse direction while the cutting mechanism 100 is in the initial state. The intermittent gear 136 that is in the start rotation position rotates in the second rotation direction (the direction of the arrow A2 in FIG. 4). The first end portion 136B of the first toothed portion 136A meshes with the second toothed portion 156A. The cam drive gear 156 is caused to rotate in the third rotation direction (the direction of the arrow A3) by the intermittent gear 136.

As shown in FIG. 6 and FIG. 13, the cam member 158 is caused to rotate in the third rotation direction by the cam drive gear 156. In the state in which the sliding portion 172A is positioned in the first rotation position, the sliding portion 172A slides with respect to the first cam surface 162A and moves to the left while resisting the urging force of the coil spring 173. The support member 168 moves to the left while resisting the urging force of the coil springs 171 and 173. The receiving block 180 that is in the first opposed position moves to the left.

When the cam drive gear 156 is caused to rotate by the intermittent gear 136 by a second specified rotation angle, the sliding portion 172A moves from the right end portion to the left end portion of the first cam surface 162A, in the state in which the sliding portion 172A is positioned in the first rotation position. The sliding member 172 moves by the distance L as far as the left end position of the movable range of the sliding member 172. In this manner, the support member 168 moves by the distance L as far as the left end position of the movable range of the support member 168. The receiving block 180 moves by the distance L as far as the second opposed position. At that time, the first toothed portion 136A is meshed with the second toothed portion 156A.

The second specified rotation angle of the cam drive gear 156 corresponds to the angle over which the first cam surface 162A is formed, and is, for example, 82 degrees. As a result of the intermittent gear 136 rotating by a third specified rotation angle, the cam drive gear 156 is caused to rotate by the second specified rotation angle. The toothed portion formation angle is larger than the third specified rotation angle. The third specified rotation angle is smaller than the first specified rotation angle. The third specified rotation angle is, for example, 48 degrees.

After the receiving block 180 has moved to the second opposed position, the DC motor 104 continues to rotate in the reverse direction. The intermittent gear 136 rotates further in the second rotation direction, and the cam member 158 rotates further in the third rotation direction. After the sliding portion 172A has moved relative to the cam member 158 as far as the right end portion of the first cam surface 162A, the sliding portion 172A slides with respect to the third cam surface 162C. The third cam surface 162C extends in parallel to the fourth rotation direction. Therefore, the sliding portion 172A does not move to the left. The movement to the right of the sliding portion 172A, which is being urged to the right by the coil spring 173, is restricted by the third cam surface 162C. Thus, the receiving block 180 is maintained in the state of being positioned in the second opposed position.

As shown in FIG. 9, while the sliding portion 172A is sliding with respect to the third cam surface 162C, the cam portion 215 rotates in the second direction (the direction of the arrow B2) from the initial rotation position to the specific rotation position. Immediately after the cam portion 215 has started to rotate in the second direction, the end surface of the right side protruding portion 211 in the second direction comes into contact with the movable portion 241A. The initial position sensor 241 outputs the ON signal instead of the OFF signal. The DC motor 104 continues to rotate in the reverse direction and the pressing pin 215A of the cam portion 215 urges the second arm portion 232 in the anti-clockwise direction in a left side view.

The link member 220 rotates in the third direction from the separated rotation position. The housing member 272 moves to the rear. The cutting blade 275 moves to the rear from the separated position (refer to FIG. 15A). Although not shown in the drawings, the housing member 272 that moves to the rear comes into contact, from the front, with the large diameter tube 9A ahead of the cutting blade 275. The movement of the housing member 272 to the rear is restricted. When the DC motor 104 continues to rotate in the reverse direction, the arm member 277 urges the cutting blade 275 (refer to FIG. 15A to FIG. 15C) to the rear. The cutting blade 275 moves to the rear, relative to the housing member 272, while resisting the urging force of the attachment spring (not shown in the drawings).

Figure 14:
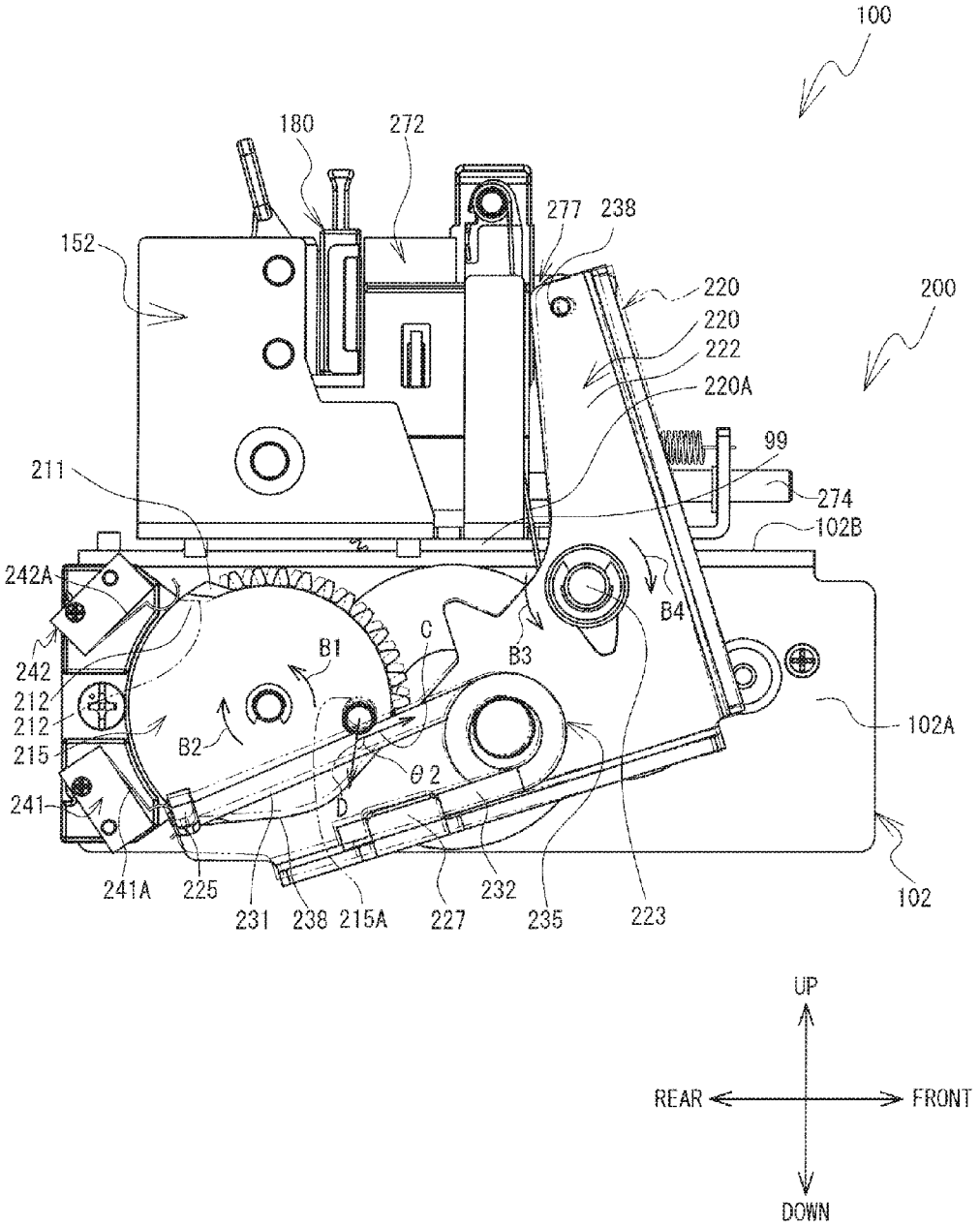
FIG. 14 is a left side view of the cutting mechanism 100 at a time of ending a full cut operation.
Figure 15A:
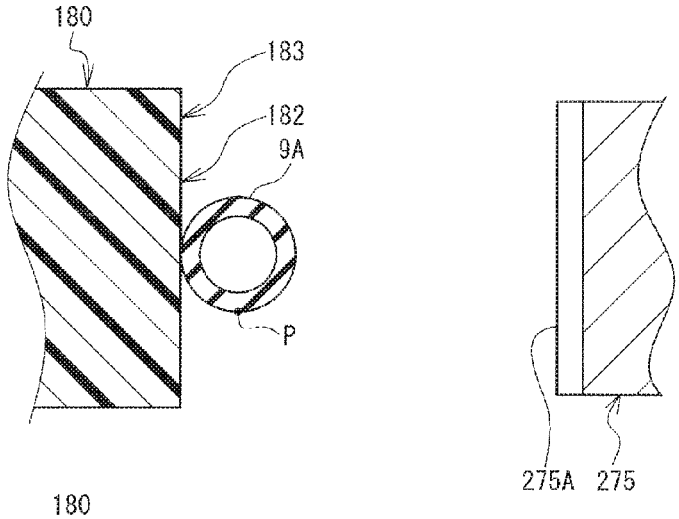
FIG. 15A is a diagram showing a positional relationship of the receiving block 180, the cutting blade 275, and the large diameter tube 9A.
Figure 15B:
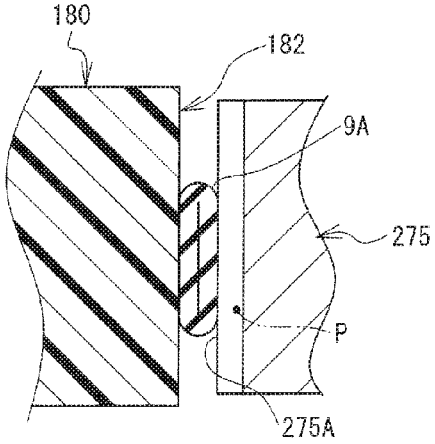
FIG. 15B is a diagram showing a positional relationship of the receiving block 180, the cutting blade 275, and the large diameter tube 9A.
Figure 15C:
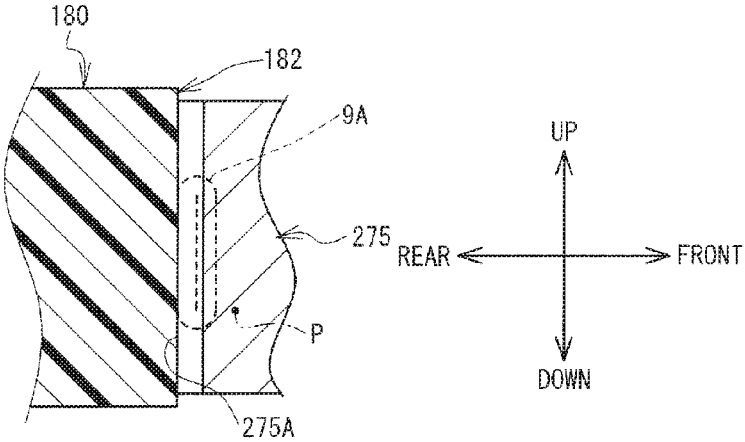
FIG. 15C is a diagram showing a positional relationship of the receiving block 180, the cutting blade 275, and the large diameter tube 9A.

As shown in FIG. 14 and FIG. 15B, the blade portion 275A moves to the clamping position. When the full cut operation is performed, the large diameter tube 9A is clamped between the cutting blade 275 that is in the clamping position and the second contact surface 182. Of the large diameter tube 9A, a portion that is between the blade portion 275A and the second contact surface 182 is elastically deformed and becomes a substantially elliptical shape that is long in the up-down direction in a left side view.

The rotation position of the link member 220 that has caused the cutting blade 275 to move to the clamping position is the above-described clamping rotation position. When the full cut operation is performed, the rotation position of the cam portion 215 that has caused the link member 220 to move to the clamping rotation position is a second intermediate rotation position. In FIG. 14, the link member 220 that is in the clamping rotation position and the cam portion 215 that is in the second intermediate rotation position are illustrated by lines of alternate long and short dashes.

When the cam portion 215 that is rotating in the second direction rotates from the initial rotation position to the second intermediate rotation position, the end surface of the left side protruding portion 212 in the second direction comes into contact with the movable portion 242A of the intermediate position sensor 242. The intermediate position sensor 242 outputs the ON signal instead of the OFF signal. In this way, the CPU 41 (refer to FIG. 16) of the control board 19 (refer to FIG. 2) can determine that the cam portion 215 has rotated to the second intermediate rotation position.

By the DC motor 104 rotating further in the reverse direction for a specified period of time, the cam portion 215 rotates further to the second direction side than the second intermediate rotation position. The pressing pin 215A presses the first arm portion 231. The first arm portion 231 is pressed in the anti-clockwise direction around the spring shaft portion 226 in a left side view. The first arm portion 231 separates slightly downward from the latching piece 225, and an amount of elastic deformation of the torsion spring 235 increases.

When the amount of elastic deformation of the torsion spring 235 increases at the time of the full cut operation, a pressing angle of the pressing pin 215A against the first arm portion 231 is an acute angle. The pressing angle when the full cut operation is performed corresponds to an angle θ2 shown in FIG. 14.

The cutting blade 275 that is being urged moves to the contact position (refer to FIG. 15C) while cutting through the large diameter tube 9A. When the full cut operation is performed, the blade portion 275A that has moved to the contact position is in contact with the second contact surface 182. The large diameter tube 9A is fully cut.

The rotation position of the link member 220 that has caused the cutting blade 275 to move to the contact position is the above-described contact rotation position. When the full cut operation is performed, the rotation position of the cam portion 215 that has caused the link member 220 to move to the contact rotation position is a second final rotation position. In FIG. 14, the link member 220 that is in the contact rotation position and the cam portion 215 that is in the second final rotation position are illustrated with solid lines. When the cam portion 215 is in the second final rotation position, the left side protruding portion 212 comes into contact with the movable portion 242A and the right side protruding portion 211 comes into contact with the movable portion 241A. As a result, the initial position sensor 241 and the intermediate position sensor 242 output the ON signals.

When the full cut operation is performed, while the cutting blade 275 is moving from the separated position to the contact position, the intermittent gear 136 rotates in the second rotation direction by a fourth specified rotation angle. The fourth specified rotation angle is smaller than the toothed portion formation angle. Thus, even when the cutting blade 275 moves from the separated position to the contact position, the first toothed portion 136A and the second toothed portion 156A are maintained in a state of being meshed with each other. The fourth specified rotation angle of the present example is 190 degrees, for example.

As shown in FIG. 6 and FIG. 13, after the cam portion 215 (refer to FIG. 14) has rotated to the second final rotation position, the DC motor 104 continues to rotate in the reverse direction. After the sliding portion 172A has slid with respect to the end portion of the third cam surface 162C in the fourth rotation direction, the sliding portion 172A slides with respect to the second cam surface 162B.

When the sliding portion 172A slides with respect to the second cam surface 162B, the sliding member 172 is urged by the coil spring 173 and moves to the right. The support member 168 moves to the right along with the sliding member 172. In this way, the receiving block 180 moves to the right from the second opposed position.

The sliding portion 172A that moves to the right comes into contact with the right end portion of the first cam surface 162A, after sliding with respect to the second cam surface 162B. The sliding member 172 moves to the right by the distance L as far as the right end position of the movable range of the sliding member 172. The support member 168 moves to the right by the distance L as far as the right end position of the movable range of the support member 168. In this way, the receiving block 180 moves from the second opposed position to the first opposed position. The rotation of the DC motor 104 in the reverse direction is stopped. At that time, the first toothed portion 136A and the second toothed portion 156A are maintained in the state of being meshed with each other. The rotation direction of the DC motor 104 is switched and the DC motor 104 starts to rotate in the forward direction.

As shown in FIG. 8, when the DC motor 104 starts to rotate in the forward direction, the cam member 158 rotates in the fourth rotation direction. The second cam surface 162B that rotates in the fourth rotation direction urges that sliding portion 172A in the clockwise direction in a left side view. After the second cam surface 162B, the sliding portion 172A comes into contact with the end portion of the specific cam surface 164 in the fourth rotation direction (the end portion of the second cam surface 162B in a direction of separation from the first shaft portion 154). The sliding member 172 rotates to the second rotation position.

While the specific cam surface 164 that rotates in the fourth rotation direction is sliding with respect to the sliding portion 172A, the movement of the support member 168 to the right is restricted by the right plate 152B, and the movement of the sliding member 172 to the right is restricted by the right wall portion 168B of the support member 168. Thus, while the sliding portion 172A is sliding with respect to the specific cam surface 164, the receiving block 180 is maintained in the state of being stopped in the first opposed position.

As shown in FIG. 9 and FIG. 14, while the sliding portion 172A is sliding with respect to the second cam surface 162B and the specific cam surface 164 in that order, the cam portion 215 rotates in the first direction from the second final rotation position. The cam portion 215 rotates to the initial rotation position from the second final rotation position via the second intermediate rotation position and the specific rotation position in that order. The link member 220 rotates from the contact rotation position to the separated rotation position via the clamping rotation position. The cutting blade 275 moves from the contact position to the separated position via the clamping position.

When the right side protruding portion 211 moves to the initial rotation position, the right side protruding portion 211 separates from the movable portion 241A. The initial position sensor 241 outputs the OFF signal instead of the ON signal. In this way, the CPU 41 of the control board 19 can determine that the cam portion 215 has rotated to the initial rotation position. The rotation of the DC motor 104 in the forward direction is stopped. The cutting blade movement mechanism 200 returns to the initial state.

As shown in FIG. 6, when the cam portion 215 has returned to the initial rotation position, the sliding portion 172A has moved relative to the cam member 158 as far as the right end portion of the first cam surface 162A from the end portion of the specific cam surface 164 in the third rotation direction. The receiving block movement mechanism 120 returns to the initial state. As a result of the above-described operations, the cutting mechanism 100 returns to the initial state after performing the full cut operation of the large diameter tube 9A.

The operation of the cutting mechanism 100 to perform the full cut operation of the small diameter tube 9B is similar to the operation to perform the full cut operation of the large diameter tube 9A and an explanation is omitted here.

[4. Details of Processing Performed by CPU 41 at Time of Cutting Operations]

Details of processing performed by the CPU 41 when the cutting mechanism 100 performs the above-described cutting operations will be explained. The CPU 41 controls and drives the DC motor 104 and thus the cutting mechanism 100 can adjust a load with which the tube 9 is clamped between the cutting blade 275 and the contact surface 183.

[4-1. Electrical Configuration of Printer 1]

The electrical configuration of the printer 1 will be explained with reference to FIG. 16, in advance of the explanation of the processing performed by the CPU 41. FIG. 16 shows only the electrical configuration relating to the cutting operations of the cutting mechanism 100. The control board 19 of the printer 1 includes the CPU 41, the ROM 42, the RAM 44, a flash memory 45, and an input/output interface 49 etc., which are connected via a data bus. Electric power is supplied to the control board 19 from the power source portion 48.

The ROM 42 stores programs used in order for the CPU 41 to perform half cut processing (refer to FIG. 18) and full cut processing (refer to FIG. 19) that will be described below. The RAM 44 temporarily stores various data.

The flash memory 45 stores data, such as a data table 450 (refer to FIG. 17). As shown in FIG. 17, a tube outer diameter Z and an urging time period T are stored in association with each other in the data table 450. The tube outer diameter Z is information indicating a type of the tube 9 to be cut. In the present embodiment, the tube outer diameter Z is information indicating the outer diameter of the tube 9 to be cut. The tube outer diameter Z of the present example includes z1, which is the outer diameter of the large diameter tube 9A, and z2, which is the outer diameter of the small diameter tube 9B. The value z1 is 7.5 (mm), for example. The value z2 is 4.5 (mm), for example.

The urging time period T indicates a time period over which the pressing pin 215A rotates in the first direction from the first intermediate rotation position or indicates a time period over which the pressing pin 215A rotates in the second direction from the second intermediate rotation position. In other words, the urging time period T indicates the time period over which the pressing pin 215A that has rotated to the first intermediate rotation position or the second intermediate rotation position presses the first arm portion 231 around the spring shaft portion 226 in the anti-clockwise direction in a left side view. Thus, the urging time period T indicates an increase in the amount of elastic deformation of the torsion spring 235. The amount of elastic deformation of the torsion spring 235 is a parameter indicating a degree of urging of the link member 220 by the torsion spring 235.

If the outer diameter of the tube 9 is the same, the urging time period T of the present example is constant, regardless of whether the half cut operation or the full cut operation is performed with respect to the tube 9. The urging time period T includes t1 corresponding to the cutting operation of the large diameter tube 9A, and t2 corresponding to the cutting operation of the small diameter tube 9B. The value t2 of the present example is a smaller value than t1. The data table 450 may store the urging time period T in association with each of a case of performing the half cut operation and a case of performing the full cut operation.

As shown in FIG. 16, the operation portion 17, a drive circuit 107, the initial position sensor 241, and the intermediate position sensor 242 are connected to the input/output interface 49. The drive circuit 107 is connected to the DC motor 104. The CPU 41 controls the drive circuit 107 and thus controls and drives the DC motor 104. When the electric power is supplied to the control board 19 from the power source portion 48, a voltage required to rotationally drive the DC motor 104 is applied to the DC motor 104. The initial position sensor 241 and the intermediate position sensor 242 each output the OFF signal or the ON signal.

[4-2. Half Cut Processing]

The half cut processing will be explained with reference to FIG. 9 to FIG. 11, FIG. 17, and FIG. 18. Before the half cut processing is performed, the cutting mechanism 100 is in the initial state. Before the half cut processing is performed, the tube 9 may be positioned by the positioning portion 190 and may be placed on the receiving block 180. When the user inputs an instruction, using the operation portion 17, to start the half cut operation, the half cut processing is performed. When the CPU 41 detects the instruction to start the half cut operation input via the operation portion 17, the CPU 41 refers to the ROM 42 and reads out, to the RAM 44, the program used to perform the half cut processing. In accordance with instructions included in the program, the CPU 41 performs processing at steps explained below. Various data acquired in the course of the processing is stored as appropriate in the RAM 44. Hereinafter, the half cut processing will be explained, taking a case in which the large diameter tube 9A is half cut as an example.

The CPU 41 determines whether the tube outer diameter Z has been input (step S11). By operating the operation portion 17, the user may input the tube outer diameter Z of the tube 9 placed on the receiving block 180. When the CPU 41 determines that the tube outer diameter Z has not been input using the operation portion 17 (no at step S11), the CPU 41 enters into a stand-by state.

When the CPU 41 determines that the tube outer diameter Z has been input using the operation portion 17 (yes at step S11), the CPU 41 acquires the urging time period T corresponding to the input tube outer diameter Z (step S12). For example, when the user inputs, using the operation portion 17, the outer diameter z1 of the large diameter tube 9A (yes at step S11), the CPU 41 refers to the data table 450 and acquires t1 as the urging time period T (step S12).

The CPU 41 controls and drives the DC motor 104 and thus causes the DC motor 104 to rotate in the forward direction (step S13). When the DC motor 104 rotates in the forward direction when the cutting mechanism 100 is in the initial state, the intermittent gear 136 (refer to FIG. 4) rotates in the first rotation direction from the start rotation position. The intermittent gear 136 idles and the receiving block 180 is maintained in a state of being positioned in the first opposed position. Meanwhile, as shown in FIG. 9 and FIG. 10, the cam portion 215 rotates in the first direction (the direction of the arrow B1) from the initial rotation position. The pressing pin 215A rotates in the first direction from the initial rotation position while remaining in contact with the first arm portion 231. The link member 220 rotates in the third direction (the direction of the arrow B3) from the separated rotation position. The cutting blade 275 moves to the rear from the separated position (refer to FIG. 11A).

Figure 18:
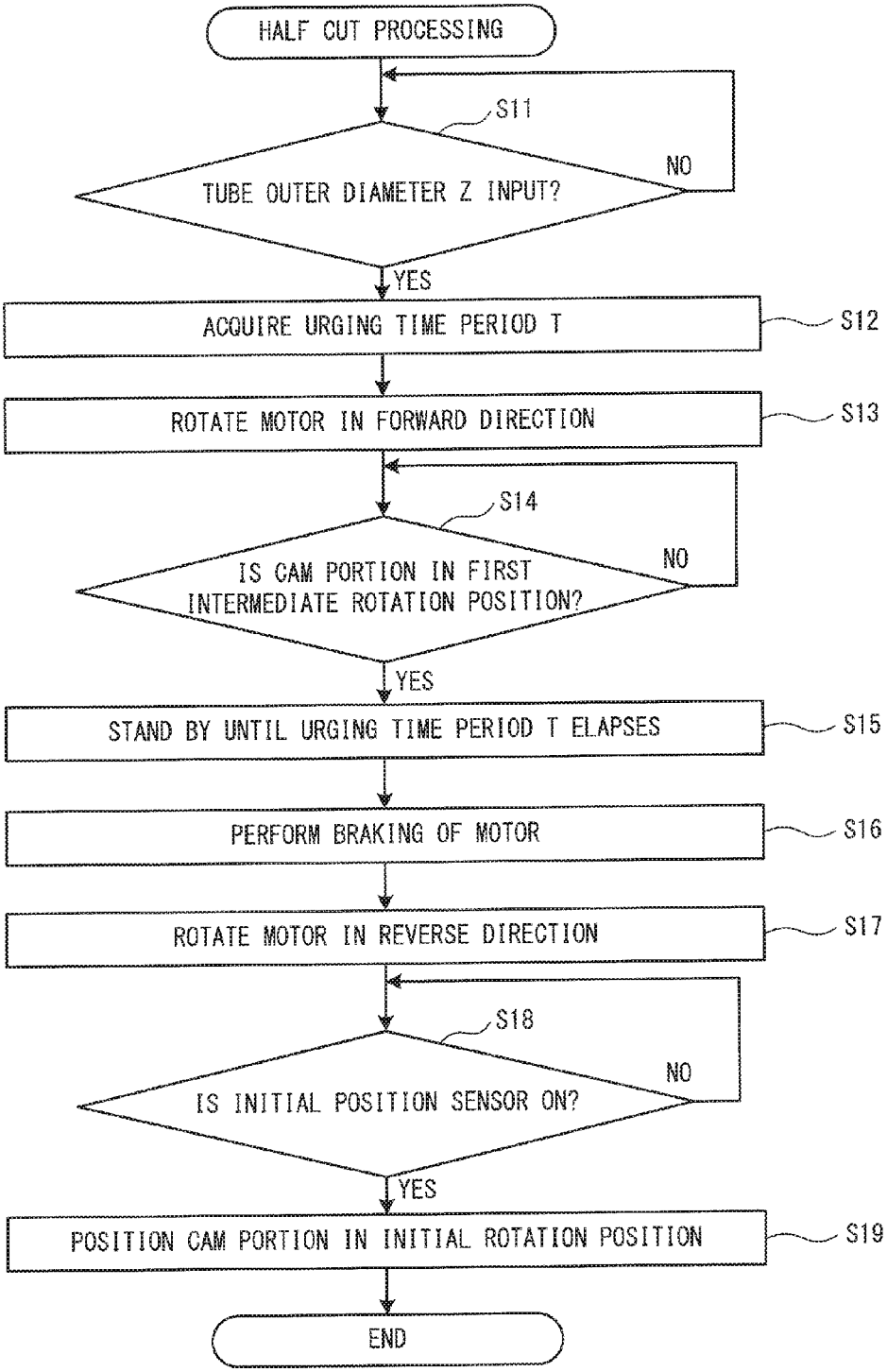
FIG. 18 is a flow chart of half cut processing.

As shown in FIG. 18, the CPU 41 determines whether the cam portion 215 has rotated to the first intermediate rotation position (step S14). When the cam portion 215 rotates from the initial rotation position to the first intermediate rotation position, the intermediate position sensor 242 outputs the ON signal instead of the OFF signal. The CPU 41 determines whether the cam portion 215 has rotated to the first intermediate rotation position based on whether the intermediate position sensor 242 has output the ON signal. When the CPU 41 determines that the cam portion 215 has not rotated to the first intermediate rotation position (no at step S14), the CPU 41 enters into the stand-by state. The cam portion 215 rotates in the first direction.

When the CPU 41 determines that the cam portion 215 has rotated to the first intermediate rotation position (yes at step S14), the CPU 41 advances the processing to step S15. As shown in FIG. 9 and FIG. 11, when the cam portion 215 rotates to the first intermediate rotation position, the link member 220 rotates to the clamping rotation position, and the cutting blade 275 moves to the clamping position. The large diameter tube 9A is clamped between the blade portion 275A and the first contact surface 181.

As shown in FIG. 18, the CPU 41 stands by until the urging time period T acquired at step S12 elapses (step S15). While the CPU 41 is standing by, a constant voltage is applied to the DC motor 104. The DC motor 104 continues to rotate in the forward direction.

Operations of the cam portion 215, the link member 220, and the cutting blade 275 until the urging time period T elapses will be explained with reference to FIG. 9 and FIG. 10. The pressing pin 215A of the cam portion 215 rotates in the first direction while pressing the first arm portion 231. The amount of elastic deformation of the torsion spring 235 increases and the link member 220 is urged in the third direction. The movement to the rear of the cutting blade 275 that is in the clamping position is temporarily restricted. Thus, immediately after the cam portion 215 has rotated in the first direction from the first intermediate rotation position, the link member 220 is maintained in a state of being positioned in the clamping rotation position. The pressing pin 215A rotates in the first direction along the escape groove 228. As the pressing pin 215A rotates in the first direction from the first intermediate rotation position, the amount of elastic deformation of the torsion spring 235 increases. The DC motor 104 rotates in the forward direction while the constant voltage is being applied. As a result, a rotation speed of the cam portion 215 decelerates, due to a reaction force received from the first arm portion 231.

As the cam portion 215 rotates in the first direction from the first intermediate rotation position, the urging force of the link member 220 acting on the cutting blade 275 increases. When the cam portion 215 rotates in the first direction from the first intermediate rotation position by a rotation movement amount corresponding to the urging time period T, the urging force acting on the cutting blade 275 becomes equal to or more than a specified value. The cutting blade 275 that is in the clamping position moves to the rear while cutting through the large diameter tube 9A. The cutting blade 275 moves to the contact position. The link member 220 rotates to the contact rotation position. The cam portion 215 moves to the first final rotation position. The large diameter tube 9A is half cut.

As shown in FIG. 18, the CPU 41 causes the DC motor 104 to perform braking (step S16). The rotation of the DC motor 104 in the forward direction decelerates and stops. The CPU 41 controls and drives the DC motor 104 and causes the DC motor 104 to rotate in the reverse direction (step S17).

As shown in FIG. 9 to FIG. 11, the cam portion 215 rotates in the second direction (the arrow B2) from the first final rotation position. The link member 220 rotates in the fourth direction (the direction of the arrow B4) from the contact rotation position. The cutting blade 275 moves to the front from the contact position.

As shown in FIG. 18, the CPU 41 determines whether the initial position sensor 241 has output the ON signal (step S18). When the cam portion 215 rotates to a rotation position further to the second direction side than the initial rotation position, the initial position sensor 241 outputs the ON signal instead of the OFF signal. When the CPU 41 determines that the initial position sensor 241 is not outputting the ON signal (no at step S18), the CPU 41 enters into the stand-by state.

While the CPU 41 is in the stand-by state, the cam portion 215 passes through the first intermediate rotation position and the initial rotation position in that order. The link member 220 moves to the separated rotation position via the clamping rotation position. In the separated rotation position, the movement of the link member 220 in the fourth direction is restricted. The cutting blade 275 moves to the separated position via the clamping position.

When the CPU 41 determines that the initial position sensor 241 has output the ON signal (yes at step S18), the CPU 41 positions the cam portion 215 in the initial rotation position (step S19). For example, after the initial position sensor 241 has output the ON signal, the CPU 41 causes the DC motor 104 to perform braking. The cam portion 215 stops further to the second direction side than the initial rotation position. The CPU 41 switches the rotation direction of the DC motor 104 and causes the DC motor 104 to rotate in the forward direction at a low speed. The CPU 41 stands by until the initial position sensor 241 outputs the OFF signal instead of the ON signal. When the CPU 41 determines that the initial position sensor 241 has output the OFF signal, the CPU 41 causes the DC motor 104 rotating in the forward direction to perform the braking. The DC motor 104 is rotating at the lower speed, and it is thus possible to stop the rotation immediately after the DC motor 104 is caused to perform the braking. The cam portion 215 stops in the initial rotation position. The CPU 41 ends the processing. The half cut processing of the large diameter tube 9A ends.

The CPU 41 also performs the above-described half cut processing when the small diameter tube 9B is half cut instead of the large diameter tube 9A. When the user inputs the tube outer diameter z2 of the small diameter tube 9B (yes at step S11), the CPU 41 refers to the data table 450 and acquires t2 as the urging time period T corresponding to the small diameter tube 9B (step S12).

The CPU 41 performs the above-described processing at steps S13 to S16. The cam portion 215 rotates to the first intermediate rotation position (yes at step S14). The DC motor 104 continues to rotate in the forward direction while the constant voltage is being applied (step S15). The pressing pin 215A rotates in the first direction from the first intermediate rotation position by a rotation movement amount corresponding to the urging time period t2. The amount of elastic deformation of the torsion spring 235 increases, and the cutting blade 275 that is in the clamping position cuts through the small diameter tube 9B and moves to the contact position. The small diameter tube 9B is half cut. After performing the above-described processing at steps S17 to S19, the CPU 41 ends the processing.

[4-3. Full Cut Processing]

The full cut processing performed by the CPU 41 will be explained with reference to FIG. 9, FIG. 14, and FIG. 19. Hereinafter, the full cut processing will be explained, taking a case in which the large diameter tube 9A is fully cut as an example. The process until the full cut processing is started is the same as that of the above-described half cut processing. Specifically, when the CPU 41 detects the instruction to start the full cut operation via the operation portion 17, the CPU 41 reads out the program to perform the full cut processing from the ROM 42 to the RAM 44. In accordance with instructions included in the program, the CPU 41 performs processing at steps explained below.

The CPU 41 determines whether the tube outer diameter Z has been input (step S21). The processing at step S21 is the same as the processing at step S11. When the CPU 41 determines that the tube outer diameter Z has not been input using the operation portion 17 (no at step S21), the CPU 41 enters into the stand-by state. When the CPU 41 determines that the tube outer diameter Z has been input using the operation portion 17 (yes at step S21), the CPU 41 acquires the urging time period T corresponding to the input tube outer diameter Z (step S22). The processing at step S22 is the same as the processing at step S12. When the user inputs z1 as the tube outer diameter Z (yes at step S21), the CPU 41 acquires t1 as the urging time period T (step S22).

The CPU 41 controls and drives the DC motor 104 and thus causes the DC motor 104 to rotate in the reverse direction (step S23). When the DC motor 104 rotates in the reverse direction when the cutting mechanism 100 is in the initial state, the intermittent gear 136 (refer to FIG. 4) rotates in the second rotation direction (the direction of the arrow A2) from the start rotation position. Before the cam portion 215 rotates from the initial rotation position to the specific rotation position, the receiving block 180 moves from the first opposed position to the second opposed position. The receiving block 180 is maintained in a state of being stopped in the second opposed position.

As shown in FIG. 9 and FIG. 14, the cam portion 215 rotates from the initial rotation position to the specific rotation position, and further rotates in the second direction (the direction of the arrow B2). The pressing pin 215A moves from the initial rotation position to the specific rotation position, and further rotates in the second direction while remaining in contact with the first arm portion 231. The link member 220 rotates in the third direction (the direction of the arrow B3) from the separated rotation position. The cutting blade 275 moves to the rear from the separated position (refer to FIG. 15A).

Figure 19:
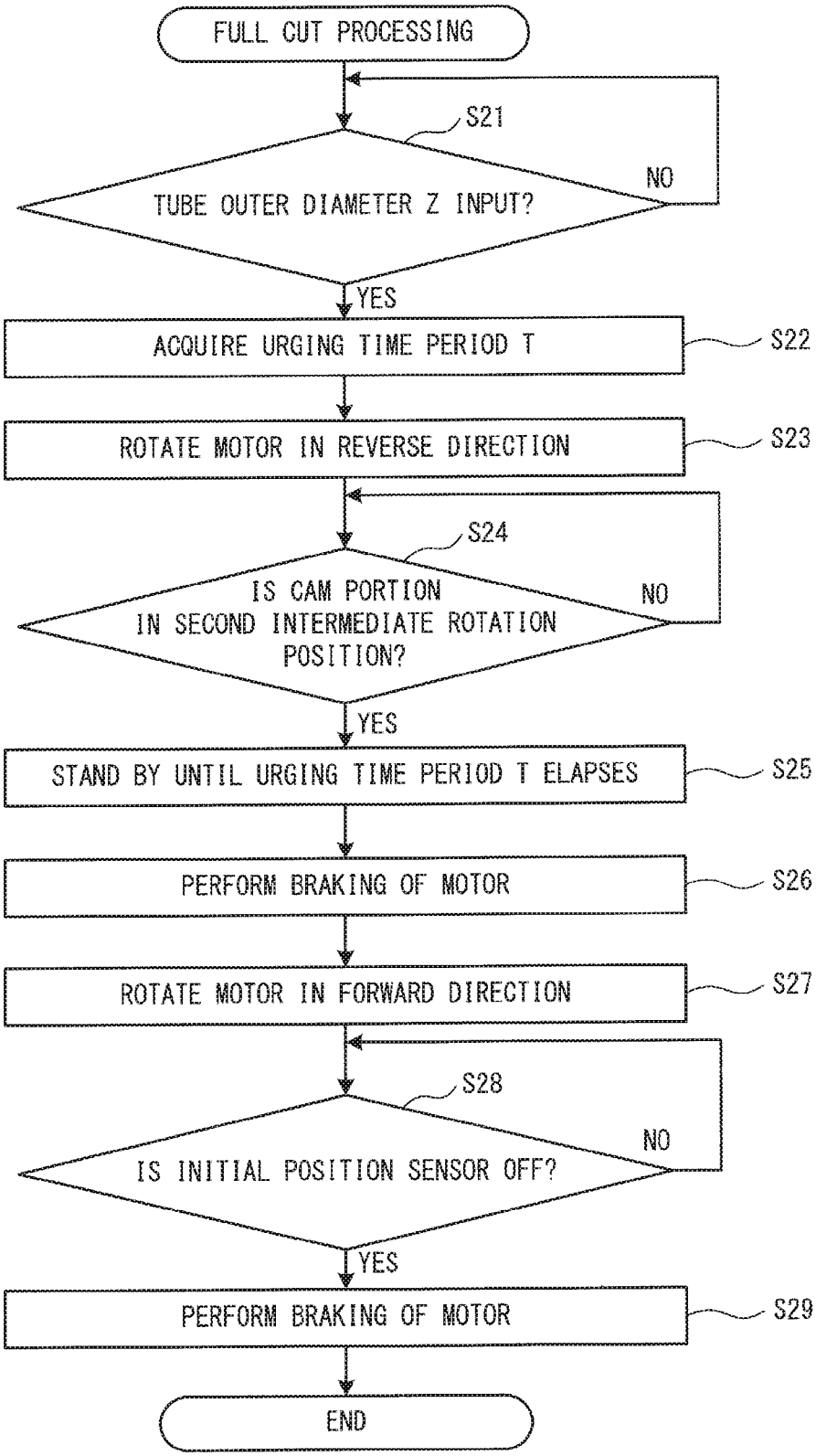
FIG. 19 is a flow chart of full cut processing.

As shown in FIG. 19, the CPU 41 determines whether the cam portion 215 has rotated to the second intermediate rotation position (step S24). When the cam portion 215 rotates from the specific rotation position to the second intermediate rotation position, the intermediate position sensor 242 outputs the ON signal instead of the OFF signal. The CPU 41 determines whether the cam portion 215 has rotated to the second intermediate rotation position based on whether the intermediate position sensor 242 has output the ON signal. When the CPU 41 determines that the cam portion 215 has not rotated to the second intermediate rotation position (no at step S24), the CPU 41 enters into the stand-by state. The cam portion 215 rotates in the second direction.

When the CPU 41 determines that the cam portion 215 has rotated to the second intermediate rotation position (yes at step S24), the CPU 41 advances the processing to step S25. As shown in FIG. 9 and FIG. 14, when the cam portion 215 rotates to the second intermediate rotation position, the link member 220 rotates to the clamping rotation position, and the cutting blade 275 moves to the clamping position. The large diameter tube 9A is clamped between the blade portion 275A and the second contact surface 182 (refer to FIG. 15B).

As shown in FIG. 19, the CPU 41 stands by until the urging time period T acquired at step S22 elapses (step S25). While the CPU 41 is standing by, a constant voltage is applied to the DC motor 104. The DC motor 104 continues to rotate in the reverse direction.

The operations of the cam portion 215, the link member 220, and the cutting blade 275 until the urging time period T elapses will be explained with reference to FIG. 9 and FIG. 14. The pressing pin 215A of the cam portion 215 rotates in the second direction while pressing the first arm portion 231. The amount of elastic deformation of the torsion spring 235 increases and the link member 220 is urged in the third direction. The movement to the rear of the cutting blade 275 that is in the clamping position is temporarily restricted. Thus, immediately after the cam portion 215 has rotated in the second direction from the second intermediate rotation position, the link member 220 is maintained in the state of being positioned in the clamping rotation position. The pressing pin 215A rotates in the second direction along the escape groove 228. As the pressing pin 215A rotates in the second direction from the second intermediate rotation position, the amount of elastic deformation of the torsion spring 235 increases. The DC motor 104 rotates in the reverse direction while the constant voltage is being applied. As a result, a rotation speed of the cam portion 215 decelerates, due to a reaction force received from the first arm portion 231.

As the cam portion 215 rotates in the second direction from the second intermediate rotation position, the urging force of the link member 220 acting on the cutting blade 275 increases. When the cam portion 215 rotates in the second direction from the second intermediate rotation position by the rotation movement amount corresponding to the urging time period T, the urging force acting on the cutting blade 275 becomes equal to or greater than a specified value. The cutting blade 275 that is in the clamping position moves to the rear while cutting through the large diameter tube 9A. The cutting blade 275 moves to the contact position (refer to FIG. 15C). The link member 220 rotates to the contact rotation position. The cam portion 215 moves to the second final rotation position. The large diameter tube 9A is fully cut.

As shown in FIG. 19, the CPU 41 causes the DC motor 104 to perform braking (step S26). The rotation of the DC motor 104 in the reverse direction decelerates and stops. While the rotation of the DC motor 104 in the reverse direction decelerates, the sliding portion 172A (refer to FIG. 13) moves relative to the cam member 158, from the end portion of the third cam surface 162C (refer to FIG. 7) in the fourth rotation direction to the second cam surface 162B. As a result, before the rotation of the DC motor 104 in the reverse direction stops, the receiving block 180 moves from the second opposed position to the first opposed position.

The CPU 41 controls and drives the DC motor 104, and causes the DC motor 104 to rotate in the forward direction at a low speed (step S27). The sliding member 172 rotates from the first rotation position to the second rotation position, and the sliding portion 172A slides with respect to the specific cam surface 164 (refer to FIG. 8). The receiving block 180 is maintained in the state of being stopped in the first opposed position.

As shown in FIG. 14, the cam portion 215 rotates in the first direction (the direction of the arrow B1) from the second final rotation position. The link member 220 rotates in the fourth direction (the direction of the arrow B4) from the contact rotation position. The cutting blade 275 moves to the front from the contact position.

As shown in FIG. 19, the CPU 41 determines whether the initial position sensor 241 has output the OFF signal (step S28). When the cam portion 215 rotates to the initial rotation position, the initial position sensor 241 outputs the OFF signal instead of the ON signal. When the CPU 41 determines that the initial position sensor 241 has not output the OFF signal (no at step S28), the CPU 41 enters into the stand-by state.

While the CPU 41 is in the stand-by state, the cam portion 215 rotates to the initial rotation position via the specific rotation position. The link member 220 rotates to the separated rotation position via the clamping rotation position. In the separated rotation position, the rotation of the link member 220 in the fourth direction is restricted. The cutting blade 275 moves to the separated position via the clamping position.

When the CPU 41 determines that the initial position sensor 241 has output the OFF signal (yes at step S28), the CPU 41 causes the DC motor 104 to perform the braking, and thus stops the DC motor 104 (step S29). The DC motor 104 is rotating at a low speed in the forward direction (step S27). Therefore, immediately after the CPU 41 has performed the processing at step S29, the rotation of the DC motor 104 in the forward direction is stopped. As a result, the cam portion 215 stops in the initial rotation position. The CPU 41 ends the processing. The full cut processing of the large diameter tube 9A ends.

Also in the case of fully cutting the small diameter tube 9B in place of the large diameter tube 9A, the CPU 41 performs the above-described full cut processing. A detailed explanation is omitted here.

[5. Example of Operational Effects]

As described above, the cam portion 215 rotates in the first direction from the first intermediate rotation position in accordance with the rotation of the DC motor 104 in the forward direction. By the pressing pin 215A pressing the first arm portion 231 in the anti-clockwise direction in a left side view, the torsion spring 235 urges the link member 220 in the third direction. The cutting blade 275 that is in the clamping position moves to the contact position while cutting through the tube 9. The link member 220 rotates to the contact rotation position, and the cam portion 215 rotates to the first final rotation position. The tube 9 is half cut. In accordance with the amount of rotation in the first direction of the cam portion 215, which is in the first intermediate rotation position, the amount of elastic deformation of the torsion spring 235 changes. As a result, the cutting mechanism 100 can adjust the load with which the tube 9 is clamped between the cutting blade 275 and the first contact surface 181. The cutting mechanism 100 includes the DC motor 104 as a driving source. Under a condition in which the same driving force is output, it is easier to make the DC motor 104 more compact compared to a stepping motor (not shown in the drawings). It is thus possible to achieve the downsized cutting mechanism 100 that can adjust the load with which the tube 9 is clamped. The printer 1 includes the cutting mechanism 100. It is thus possible to realize the downsized printer 1 that can adjust the load with which the tube 9 is clamped.

When the DC motor 104 rotates in the forward direction when the cutting mechanism 100 is in the initial state, and when the DC motor 104 rotates in the reverse direction when the cutting mechanism 100 is in the initial state, the cutting blade 275 moves from the separated position to the contact position via the clamping position. When the DC motor 104 rotates in the forward direction and when the DC motor 104 rotates in the reverse direction, the cutting mechanism 100 can perform the cutting operation on the tube 9. It is therefore possible to diversify the cutting operations on the tube 9. In the present embodiment, when the DC motor 104 rotates in the forward direction when the cutting mechanism 100 is in the initial state, the receiving block 180 is maintained in the state of being stopped in the first opposed position. On the other hand, when the DC motor 104 rotates in the reverse direction, the receiving block 180 moves from the first opposed position to the second opposed position. As a result, simply by switching the rotation direction of the DC motor 104, it is possible to perform one of the half cut operation and the full cut operation on the tube 9. The cutting mechanism 100 can thus diversify the cutting operations.

Simply by the pressing pin 215A that is in the first intermediate rotation position or the second intermediate rotation position pressing the first arm portion 231 in the anti-clockwise direction, in a left side view, around the spring shaft portion 226, the first arm portion 231 is displaced toward the second arm portion 232 and the amount of elastic deformation of the torsion spring 235 increases. Further, when the DC motor 104 rotates in the reverse direction, compared to when it rotates in the forward direction, the position at which the pressing pin 215A comes into contact with the first arm portion 231 is closer to the coil portion 233. Compared to when the full cut operation is performed, when the half cut operation is performed, the pressing pin 215A comes into contact with the first arm portion 231 at a position separated from the coil portion 233. Thus, when the cutting mechanism 100 performs the half cut operation, a displacement amount of the first arm portion 231 in relation to the rotation amount of the cam portion 215 is smaller. As a result, when the DC motor 104 is caused to rotate in the forward direction, the cutting mechanism 100 can accurately adjust the load with which the tube 9 is clamped.

When the half cut operation is performed, the pressing angle of the pressing pin 215A against the first arm portion 231 is an acute angle. When the full cut operation is performed, the pressing angle of the pressing pin 215A against the first arm portion 231 is an obtuse angle. Regardless of whether the half cut operation or the full cut operation is performed, the pressing angle of the pressing pin 215A against the first arm portion 231 is an angle that is different from 90 degrees. Thus, the pressing pin 215A rotates easily in one of the first direction and the second direction while pressing the first arm portion 231 in the anti-clockwise direction, in a left side view, around the spring shaft portion 226. As a result, the driving force output by the DC motor 104 required to increase the amount of elastic deformation of the torsion spring 235 is reduced.

The CPU 41 acquires the urging time period T corresponding to the tube outer diameter Z (step S12). The CPU 41 drives the DC motor 104 and causes the cam portion 215, which is in the first intermediate rotation position, to rotate in the first direction by the rotation movement amount corresponding to the urging time period T acquired at step S12 (step S15). Thus, the cutting mechanism 100 can automatically adjust the load with which the tube 9 is clamped, in accordance with the urging time period T acquired at step S12.

The CPU 41 acquires the urging time period T corresponding to the tube outer diameter Z input by the user on the operation portion 17 (step S12). The CPU 41 causes the cam portion 215 to rotate in the first direction from the first intermediate rotation position by the rotation movement amount corresponding to the urging time period T acquired at step S12 (step S15). As a result, the cutting mechanism 100 can perform the cutting operation depending on the type of the tube 9.

The amount of elastic deformation of the torsion spring 235 changes depending on the time over which the cam portion 215 rotates in the first direction from the first intermediate rotation position. Thus, the CPU 41 can adjust the load with which the tube 9 is clamped between the first contact surface 181 and the cutting blade 275, simply by controlling the time over which the cam portion 215 that is in the first intermediate rotation position rotates in the first direction. As a result, the cutting mechanism 100 can simplify the processing performed by the CPU 41 when the tube 9 is half cut.

When performing the half cut processing and when performing the full cut processing, the CPU 41 acquires the urging time period T corresponding to the tube outer diameter Z (step S12, step S22). Therefore, when performing the full cut operation and when performing the half cut operation, the cutting mechanism 100 can automatically adjust the load with which the tube 9 is clamped.

When performing the half cut processing and when performing the full cut processing, the CPU 41 acquires the urging time period T corresponding to the tube outer diameter Z input by the user via the operation portion 17 (step S12, step S22). The CPU 41 causes the cam portion 215 to rotate by the rotation movement amount corresponding to the urging time period T acquired at step S12 or step S22 (step S15, step S25). As a result, regardless of whether performing the half cut operation or the full cut operation, the cutting mechanism 100 can perform the cutting operation depending on the type of the tube 9.

When performing the half cut processing and when performing the full cut processing, the CPU 41 acquires the urging time period T corresponding to the tube outer diameter Z (step S12, step S22). The amount of elastic deformation of the torsion spring 235 changes in accordance with the time over which the cam portion 215 rotates in the first direction from the first intermediate rotation position, and with the time over which the cam portion 215 rotates in the second direction from the second intermediate rotation position. As a result, the CPU 41 can adjust the load with which the tube 9 is clamped between the contact surface 183 and the cutting blade 275, simply by controlling the time over which the cam portion 215 that is in the first intermediate rotation position rotates in the first direction or the time over which the cam portion 215 that is in the second intermediate rotation position rotates in the second direction. Thus, the cutting mechanism 100 can simplify the processing performed by the CPU 41 when performing the cutting operation on the tube 9.

The driving source of the cutting mechanism 100 is the DC motor 104. It is thus possible to reduce the cost of the cutting mechanism 100, compared to a case in which the driving source is the stepping motor. The DC motor 104 easily rotates at a high speed while outputting a high driving force, compared to the stepping motor (not shown in the drawings). Even when the cam portion 215 rotates at a high speed, the pressing pin 215A can press the first arm portion 231 in the anti-clockwise direction, in a left side view, around the spring shaft portion 226 and thus can increase the amount of elastic deformation of the torsion spring 235. As a result, the cutting mechanism 100 can speed up the cutting operation on the tube 9.

The cam portion 215 moves to one of the first intermediate rotation position and the second intermediate rotation position while the pressing pin 215A is in contact with the first arm portion 231. While the cam portion 215 is rotating to one of the first intermediate rotation position and the second intermediate rotation position, the blade portion 275A of the cutting blade 275 comes into contact with the tube 9. In the instant at which the blade portion 275A and the tube 9 come into contact, the blade portion 275A is subjected to a reaction force from the tube 9. Even in this case, the reaction force acting on the blade portion 275A is easily absorbed by the torsion spring 235. As a result, it is difficult for an excessive force to act on the blade portion 275A. The cutting mechanism 100 can thus extend the life of the cutting blade 275.

Various modifications can be made to the above-described embodiment. In place of the torsion spring 235, a coil spring (not shown in the drawings) may be provided on the link member 220. By the pressing pin 215A that rotates in the first direction or the second direction compressing the coil spring (not shown in the drawings), the coil spring can urge the link member 220 that is in the clamping rotation position in the third direction. The cutting blade 275 that is in the clamping position can be urged toward the receiving block 180.

Instead of storing the urging time period T, the data table 450 may store a rotation movement amount by which the pressing pin 215A rotates in the first direction from the first intermediate rotation position, and a rotation movement amount by which the pressing pin 215A rotates in the second direction from the second intermediate rotation position. Instead of storing the tube outer diameter Z, the data table 450 may store a hardness of the tube 9 or a material of the tube 9.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cutting device comprising:

a receiving block configured such that an object to be cut is arranged thereon;

a cutting blade that includes a blade portion, the cutting blade being configured to move between a separated position and a contact position via a clamping position, the separated position being a position in which the blade portion is separated from the receiving block, the contact position being a position in which the blade portion is in contact with the receiving block, and the cutting blade being configured, when the cutting blade is in the clamping position, to clamp the object between the blade portion and the receiving block;

a first rotating member coupled with the cutting blade, the first rotating member being configured to cause the cutting blade to move from the separated position to the contact position via the clamping position, by the first rotating member rotating in a specified direction from a separated rotation position to a contact rotation position via a clamping rotation position;

an elastic member provided on the first rotating member;

a DC motor; and a second rotating member configured to rotate in accordance with rotation of the DC motor, the second rotating member being configured to cause the first rotating member to rotate from the separated rotation position to the clamping rotation position by the second rotating member rotating in a first direction from an initial rotation position to a first intermediate rotation position while being in contact with the elastic member, and the second rotating member being configured to increase an amount of elastic deformation of the elastic member and urge the first rotating member in the specified direction by the second rotating member rotating in the first direction from the first intermediate rotation position while being in contact with the elastic member.

2. The cutting device according to claim 1, wherein the DC motor is configured to cause the second rotating member to rotate in the first direction by the DC motor rotating in a forward direction, the DC motor is configured to cause the second rotating member to rotate in a second direction by the DC motor rotating in a reverse direction, the second direction being a direction opposite to the first direction, the second rotating member is configured to rotate between a second intermediate rotation position and the initial rotation position, the second intermediate rotation position being positioned on an opposite side to the first intermediate rotation position with respect to the initial rotation position in a rotational direction of the second rotating member, the second rotating member is configured to cause the first rotating member to rotate from the separated rotation position to the clamping rotation position by the second rotating member rotating in the second direction from the initial rotation position to the second intermediate rotation position in accordance with the rotation of the DC motor in the reverse direction, and the second rotating member is configured to increase the amount of elastic deformation of the elastic member and urge the first rotating member in the specified direction by the second rotating member rotating in the second direction from the second intermediate rotation position while being in contact with the elastic member.

3. The cutting device according to claim 2, wherein the elastic member includes a coil portion, a first arm portion, and a second arm portion, the coil portion being supported by the first rotating member, the first arm portion extending from one end portion of the coil portion, the first arm portion being configured to come into contact with the second rotating member, the second arm portion extending from another end portion of the coil portion, and the second arm portion being configured to come into contact with the first rotating member, and the second rotating member is configured to come into contact with the first arm portion at a position separated further from the coil portion when the second rotating member rotates in the first direction than when the second rotating member rotates in the second direction.

4. The cutting device according to claim 3, wherein when the second rotating member comes into contact with the first arm portion, a tangential direction in a rotation direction of the second rotating member is one of an acute angle and an obtuse angle with respect to an extending direction of the first arm portion.

5. The cutting device according to claim 2, further comprising:

a detection portion configured to detect whether the second rotating member is in a specific rotation position;

a first determination portion configured to determine whether the second rotating member is in the first intermediate rotation position, based on a detection result of the detection portion;

a second determination portion configured to determine whether the second rotating member is in the second intermediate rotation position, based on a detection result of the detection portion;

a first acquisition portion configured to acquire first information, the first information indicating a degree of urging of the first rotating member by the elastic member when the second rotating member rotates in the first direction from the first intermediate rotation position;

a second acquisition portion configured to acquire second information, the second information indicating a degree of urging of the first rotating member by the elastic member when the second rotating member rotates in the second direction from the second intermediate rotation position;

a first rotation control portion configured to, in response to determining by the first determination portion that the second rotating member is in the first intermediate rotation position, control and drive the DC motor to cause the second rotating member to rotate in the first direction by a movement amount corresponding to the first information acquired by the first acquisition portion; and a second rotation control portion configured to, in response to determining by the second determination portion that the second rotating member is in the second intermediate rotation position, control and drive the DC motor to cause the second rotating member to rotate in the second direction by a movement amount corresponding to the second information acquired by the second acquisition portion.

6. The cutting device according to claim 5, further comprising:

an input portion configured to receive an input of object to be cut information, the object to be cut information indicating a type of the object to be cut, wherein the first acquisition portion is configured to acquire, from a first storage portion storing the object to be cut information and the first information in association with each other, the first information corresponding to the object to be cut information input via the input portion, and the second acquisition portion is configured to acquire, from a second storage portion storing the object to be cut information and the second information in association with each other, the second information corresponding to the object to be cut information input via the input portion.

7. The cutting device according to claim 5, wherein the first information is a time period over which the second rotating member rotates in the first direction from the first intermediate rotation position, the second information is a time period over which the second rotating member rotates in the second direction from the second intermediate rotation position, the first rotation control portion is configured to, in response to determining by the first determination portion that the second rotating member is in the first intermediate rotation position, cause the second rotating member to rotate in the first direction until the time period corresponding to the first information acquired by the first acquisition portion elapses, and the second rotation control portion is configured to, in response to determining by the second determination portion that the second rotating member is in the second intermediate rotation position, cause the second rotating member to rotate in the second direction until the time period corresponding to the second information acquired by the second acquisition portion elapses.

8. The cutting device according to claim 1, further comprising:

a detection portion configured to detect whether the second rotating member is in a specific rotation position;

a first determination portion configured to determine whether the second rotating member is in the first intermediate rotation position, based on a detection result of the detection portion;

a first acquisition portion configured to acquire first information, the first information indicating a degree of urging of the first rotating member by the elastic member when the second rotating member rotates in the first direction from the first intermediate rotation position; and a first rotation control portion configured to, in response to determining by the first determination portion that the second rotating member is in the first intermediate rotation position, control and drive the DC motor to cause the second rotating member to rotate in the first direction by a movement amount corresponding to the first information acquired by the first acquisition portion.

9. The cutting device according to claim 8, further comprising:

an input portion configured to receive an input of object to be cut information, the object to be cut information indicating a type of the object to be cut, wherein the first acquisition portion is configured to acquire, from a first storage portion storing the object to be cut information and the first information in association with each other, the first information corresponding to the object to be cut information input via the input portion.

10. The cutting device according to claim 8, wherein the first information indicates a time period over which the second rotating member rotates in the first direction from the first intermediate rotation position, and the first rotation control portion is configured to, in response to determining by the first determination portion that the second rotating member is in the first intermediate rotation position, cause the second rotating member to rotate in the first direction until the time period indicated by the first information acquired by the first acquisition portion elapses.

11. A printer comprising the cutting device according to claim 1, further comprising:

a print portion configured to perform printing on the object to be cut; and a supply portion configured to supply, to the cutting device, the object on which printing has been performed by the print portion.

* * * * *